US010337351B2

(12) United States Patent
Fujimura et al.

(10) Patent No.: US 10,337,351 B2
(45) Date of Patent: Jul. 2, 2019

(54) PIPING SYSTEM, STEAM TURBINE PLANT, AND METHOD OF CLEANING PIPING SYSTEM

(71) Applicant: MITSUBISHI HITACHI POWER SYSTEMS, LTD., Kanagawa (JP)

(72) Inventors: Daiki Fujimura, Kanagawa (JP); Ayumu Kuroshima, Kanagawa (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 314 days.

(21) Appl. No.: 15/515,314

(22) PCT Filed: Oct. 7, 2015

(86) PCT No.: PCT/JP2015/078528
§ 371 (c)(1),
(2) Date: Mar. 29, 2017

(87) PCT Pub. No.: WO2016/067864
PCT Pub. Date: May 6, 2016

(65) Prior Publication Data

US 2017/0211414 A1 Jul. 27, 2017

(30) Foreign Application Priority Data

Oct. 30, 2014 (JP) ..... 2014-222005

(51) Int. Cl.
*F01D 25/00* (2006.01)
*F17D 1/02* (2006.01)
(Continued)

(52) U.S. Cl.
CPC ..... *F01D 25/002* (2013.01); *B08B 9/032* (2013.01); *F01D 25/00* (2013.01); *F01K 7/165* (2013.01);
(Continued)

(58) Field of Classification Search
CPC ..... F01D 25/002; F01D 25/00; F22B 37/48; F01K 7/165; B08B 9/032; F17D 1/02; F05D 2220/31
See application file for complete search history.

(56) References Cited

U.S. PATENT DOCUMENTS 4,449,544 A * 5/1984 Soderberg ..... F16K 5/0668 137/15.04

FOREIGN PATENT DOCUMENTS

JP 61-22517 2/1986
JP 61-261604 11/1986
(Continued)

OTHER PUBLICATIONS

Written Opinion of the International Searching Authority dated Jan. 12, 2016 in corresponding (PCT) International Application No. PCT/JP2015/078528.
(Continued)

*Primary Examiner* — Eldon T Brockman
(74) *Attorney, Agent, or Firm* — Wenderoth, Lind & Ponack, L.L.P.

(57) ABSTRACT

A piping system of a steam turbine plant includes: a piping member including a first pipe section including a first passage, a second pipe section including a second passage, a connection section arranged between the first pipe section and the second pipe section and including a connection passage that connects the first passage and the second passage, and a third pipe section including a third passage connected with the connection passage through an opening, the first pipe section being supplied with steam; a steam stop valve connected with the third pipe section; and a turbine bypass valve connected with the second pipe section. An
(Continued)

angle made by a first central axis and a second central axis is larger than an angle made by the first central axis and a third central axis.

11 Claims, 24 Drawing Sheets

(51) Int. Cl.
*B08B 9/032* (2006.01)
*F01K 7/16* (2006.01)
*F22B 37/48* (2006.01)

(52) U.S. Cl.
CPC ..... *F17D 1/02* (2013.01); *F22B 37/48* (2013.01); *F05D 2220/31* (2013.01)

(56) References Cited

FOREIGN PATENT DOCUMENTS

| | | |
|---|---|---|
| JP | 8-28208 | 1/1996 |
| JP | 8-144710 | 6/1996 |
| JP | 2008-215098 | 9/2008 |

OTHER PUBLICATIONS

International Search Report dated Jan. 12, 2016 in International (PCT) Application No. PCT/JP2015/078528.
Decision to Grant a Patent dated Jan. 10, 2017 in Japanese Application No. 2014-222005, with English translation.

* cited by examiner

PIPING SYSTEM, STEAM TURBINE PLANT, AND METHOD OF CLEANING PIPING SYSTEM

FIELD

The present invention relates to a piping system, a steam turbine plant, and a method of cleaning a piping system.

BACKGROUND

A steam turbine plant includes a steam turbine and a piping system including piping in which steam flows. The piping of the piping system includes steam piping in which the steam to be supplied to the steam turbine flows and bypass piping branching from the steam piping. The steam generated in a steam generation device including a heating unit is supplied to the steam turbine through the steam piping of the piping system. At the time of start of the steam turbine plant or at the time of an excessive increase in pressure in the steam piping, the steam flows in the bypass piping. The steam is supplied to the bypass piping at the time of start of the steam turbine plant, thereby to improve starting performance of the steam turbine plant.

Blowing out (flushing) to remove foreign substances in the piping is conducted before the start of the steam turbine plant after completion of construction for building the steam turbine plant, after completion of alteration, or after long-term suspension. The blowing out includes processing of supplying steam to the piping. The foreign substances in the piping are blown out by the steam supplied to the piping. Accordingly, the foreign substances in the piping are removed. The steam supplied to the piping in the blowing out is free-blown (released into the atmosphere). An example of the technology regarding the blowing out is disclosed in Patent Literature 1.

CITATION LIST

Patent Literature

Patent Literature 1: Japanese Laid-open Patent Publication No. 61-261604 A

SUMMARY

Technical Problem

An increase in the man-hour of the blowing out and an increase in the time required for the blowing out result in a delay in operation timing of the steam turbine plant. Further, the increase in the time required for the blowing out increases the consumption of water and fuel necessary for the blowing out.

An objective of an aspect of the present invention is to provide a piping system, a steam turbine plant, and a method of cleaning a piping system that can suppress an increase in the time required for blowing out.

Solution to Problem

According to a first aspect of the present invention, a piping system of a steam turbine plant comprises: a piping member including a first pipe section including a first passage, a second pipe section including a second passage, a connection section arranged between the first pipe section and the second pipe section and including a connection passage that is configured to connect the first passage and the second passage, and a third pipe section including a third passage connected with the connection passage through an opening, the first pipe section being supplied with steam; a steam stop valve connected with the third pipe section; and a turbine bypass valve connected with the second pipe section, wherein an angle made by a first central axis of the first pipe section and a second central axis of the second pipe section is larger than an angle made by the first central axis and a third central axis of the third pipe section.

According to the first aspect of the present invention, the angle made by the first central axis of the first pipe section and the second central axis of the second pipe section is larger than the angle made by the first central axis and the third central axis of the third pipe section. Therefore, when the steam is supplied to the first pipe section, the flow rate of the steam flowing from the first pipe section into the second pipe section becomes higher than the flow rate of the steam flowing from the first pipe section into the third pipe section. In other words, the steam supplied to the first pipe section is supplied principally to the second pipe section. Foreign substances in the first pipe section are moved principally to the second pipe section. Since the amount of the foreign substances moved from the first pipe section to the third pipe section is suppressed, contamination of the third pipe section, the steam stop valve, and steam piping in which the steam stop valve is arranged is suppressed. Therefore, blowing out of the steam piping can be omitted. Therefore, an increase in the time required for the blowing out is suppressed.

In the first aspect of the present invention, the first central axis and the second central axis may be parallel to each other.

Accordingly, the steam supplied to the first pipe section is smoothly supplied to the second pipe section. Therefore, movement of the foreign substances from the first pipe section into the third pipe section is sufficiently suppressed.

In the first aspect of the present invention, the first central axis and the second central axis may coincide with each other.

Accordingly, the first pipe section and the second pipe section are formed in a straight pipe shape, and the movement of the foreign substances from the first pipe section into the third pipe section is sufficiently suppressed.

In the first aspect of the present invention, the first central axis and the third central axis may be perpendicular to each other.

Accordingly, the movement of the foreign substances from the first pipe section into the third pipe section is sufficiently suppressed.

In the first aspect of the present invention, the opening may be arranged above a central axis of the connection section.

Accordingly, even if at least a part of the foreign substances in the first pipe section is moved into the third pipe section through the opening, the foreign substances drop from the third pipe section due to the action of gravity. Therefore, contamination of the third pipe section, the steam piping, and the steam stop valve is suppressed.

In the first aspect of the present invention, an inlet of the steam stop valve into which the steam from the third pipe section flows may be arranged above a central axis of the connection section.

Accordingly, even if at least a part of the foreign substances in the first pipe section is moved to a vicinity of the inlet of the steam stop valve through the third pipe section, the foreign substances drop from the inlet of the steam stop valve due to the action of gravity. Therefore, contamination of the steam stop valve is suppressed.

In the first aspect of the present invention, the second pipe section may be arranged above the first pipe section.

Accordingly, even if the steam is liquefied in the second pipe section, the liquid drops due to the action of gravity. Therefore, accumulation of the liquid in the second pipe section is suppressed.

According to a second aspect of the present invention, a steam turbine plant comprising the piping system of the first aspect is provided.

According to the second aspect of the present invention, an increase in the time required for the blowing out is suppressed.

According to a third aspect of the present invention, a method of cleaning a piping system of a steam turbine plant is provided. The piping system includes: a piping member including a first pipe section including a first passage, a second pipe section including a second passage, a connection section arranged between the first pipe section and the second pipe section and including a connection passage that is configured to connect the first passage and the second passage, and a third pipe section including a third passage connected with the connection passage through an opening, an angle made by a first central axis of the first pipe section and a second central axis of the second pipe section being larger than an angle made by the first central axis and a third central axis of the third pipe section; a steam generation device connected with the first pipe section; a steam stop valve connected with the third pipe section having had an inside cleaned; and a turbine bypass valve connected with the second pipe section. The method comprises the steps of: closing the steam stop valve; and supplying steam from the steam generation device and cleaning the first pipe section and the second pipe section.

According to the third aspect of the present invention, the angle made by the first central axis of the first pipe section and the second central axis of the second pipe section is larger than the angle made by the first central axis and the third central axis of the third pipe section. Therefore, when the steam is supplied from the steam generation device to the first pipe section, the steam in the first pipe section is supplied principally to the second pipe section. Accordingly, the foreign substances in the first pipe section and the foreign substances in the second pipe section are discharged, and the first pipe section and the second pipe section are cleaned. The third pipe section is cleaned in advance. Since the amount of the foreign substances moved from the first pipe section into the third pipe section is suppressed, contamination of the third pipe section is suppressed. Further, supply of the steam from the steam generation device is performed in a state where the steam stop valve is closed. Therefore, movement of the foreign substances into the steam piping in which the steam stop valve is arranged, and movement of the foreign substances into the steam turbine through the steam piping are suppressed. Accordingly, contamination of the steam piping is suppressed, and the blowing out of the steam piping can be omitted. Therefore, an increase in the time required for the blowing out is suppressed.

In the third aspect of the present invention, the method may comprise: conducting a test to close the steam stop valve; closing the steam stop valve after completion of the test; and supplying steam from the steam generation device in a state where the steam stop valve is closed and performing the cleaning.

Accordingly, the first pipe section and the second pipe section can be cleaned while the movement of the foreign substances into the steam turbine through the steam piping can be suppressed. A test called interlocking test is conducted for the steam stop valve arranged in the steam piping connected to the steam turbine. The interlocking test is a test to confirm whether the steam stop valve can be normally closed on the basis of a trip signal. Since the steam stop valve is closed after normality is confirmed, the movement of the foreign substances into the steam turbine through the steam piping is suppressed. Further, since the steam piping and the steam stop valve are not blown out, disassembly of the steam stop valve is not necessary. Therefore, the number of times the interlocking test is conducted can be minimized. Therefore, an increase in the time required for the blowing out is suppressed.

In the third aspect of the present invention, the method may comprise: conducting connection between the second pipe section and the turbine bypass valve in a state where the turbine bypass valve is disassembled; and assembling the turbine bypass valve after the cleaning.

Accordingly, connection between the turbine bypass valve and the second piping can be smoothly conducted. Since connection between the second pipe section and the turbine bypass valve is conducted in a state where the turbine bypass valve is disassembled, the bypass piping in which the turbine bypass valve is arranged and the second pipe section can be inspected (including visual inspection) through the disassembled turbine bypass valve. After cleaning, the turbine bypass valve is assembled. The bypass piping in which the turbine bypass valve is arranged is not connected with the steam turbine. That is, the steam passing through the turbine bypass valve is not supplied to the steam turbine. Therefore, it is not necessary to conduct the interlocking test for the turbine bypass valve. Therefore, the steam turbine plant can be promptly operated after the turbine bypass valve is assembled. Accordingly, an increase in the time required for the blowing out is suppressed.

Advantageous Effects of Invention

According to an aspect of the present invention, a piping system, a steam turbine plant, and a method of cleaning a piping system that can suppress an increase in the time required for blowing out are provided.

DESCRIPTION OF EMBODIMENTS

Hereinafter, embodiments according to the present invention will be described with reference to the drawings. However, the present invention is not limited thereto. Constituent elements of the embodiments to be described below can be appropriately combined. Further, some of the constituent elements may not be used.

First Embodiment

Figure 1:
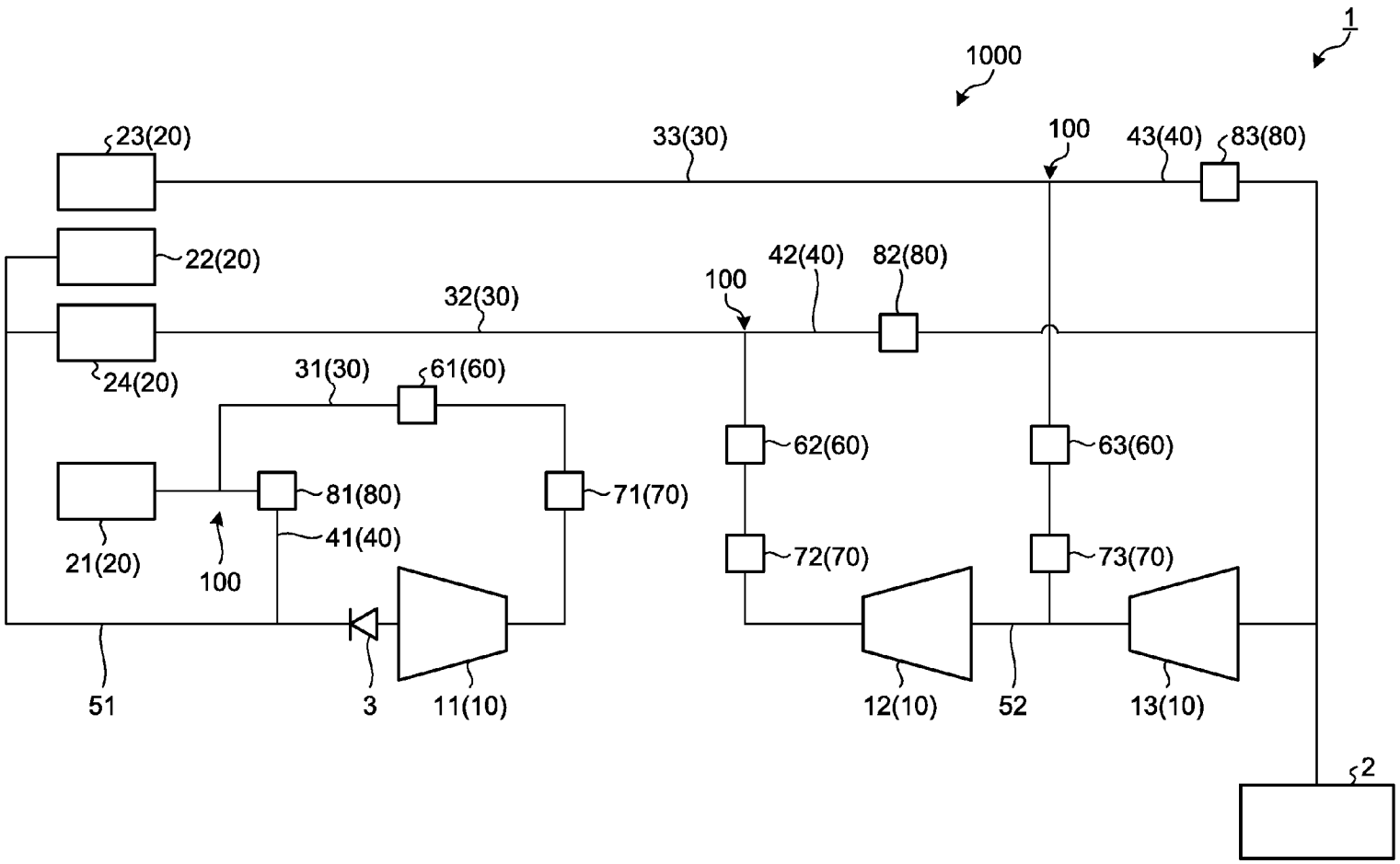
FIG. 1 is a diagram schematically illustrating an example of a steam turbine plant according to a first embodiment.

A first embodiment will be described. FIG. 1 is a diagram schematically illustrating an example of a steam turbine plant 1 according to the present embodiment. As illustrated in FIG. 1, the steam turbine plant 1 includes a steam turbine 10, a steam generation device 20 that generates steam, and a piping system 1000 including piping in which the steam flows.

In the present embodiment, the steam turbine 10 includes a high-pressure turbine 11, an intermediate-pressure turbine 12, and a low-pressure turbine 13.

In the present embodiment, the steam generation device 20 includes a high-pressure heating unit 21, an intermediate-pressure heating unit 22, a low-pressure heating unit 23, and a reheating unit 24.

In the present embodiment, the steam turbine plant 1 is combined with a gas turbine and a heat recovery steam generator. The heat recovery steam generator (HRSG) generates steam, using a flue gas at a high temperature discharged from the gas turbine. The steam generation device 20 includes the heat recovery steam generator. The steam generation device 20 generates the steam, using the flue gas discharged from the gas turbine.

The steam generated in the steam generation device 20 is supplied to the steam turbine 10 through the piping system 1000. The steam turbine 10 is operated by the supplied steam. A generator (not illustrated) is connected to the steam turbine 10. The generator is driven by the operation of the steam turbine 10. Accordingly, power generation is performed.

That is, in the present embodiment, the steam turbine plant 1 is used as a part of a gas turbine combined cycle (GTCC) power generation plant. Note that, in the present embodiment, the steam turbine plant 1 is a part of the gas turbine combined cycle, but is not necessarily limited thereto. The steam turbine plant 1 may be a conventional-type thermal power generation facility, which does not use gas turbine exhaust heat as a heat source. Further, its use is not limited to the power generation, and the steam turbine plant 1 may be a steam turbine plant including a steam turbine for driving machines, for example. Further, its working fluid is not limited to water, and the steam turbine plant 1 may be a steam turbine plant using an organic medium evaporating at a lower temperature than water, for example.

The high-pressure heating unit 21 includes a drum and a high-pressure superheater. The high-pressure heating unit 21 generates high-pressure steam. The intermediate-pressure heating unit 22 includes a drum and an intermediate-pressure superheater. The intermediate-pressure heating unit 22 generates intermediate-pressure steam. The low-pressure heating unit 23 includes a drum and a low-pressure superheater. The low-pressure heating unit 23 generates low-pressure steam. The reheating unit 24 includes a repeater. The reheating unit 24 heats the steam discharged from the high-pressure turbine 11 and the steam supplied from the intermediate-pressure heating unit 22.

The piping system 1000 includes steam piping 30 in which the steam to be supplied to the steam turbine 10 flows, and bypass piping 40 branching from the steam piping 30. Further, the piping system 1000 includes low-temperature reheat steam piping 51 connected to an outlet of the high-pressure turbine 11, and piping 52 that connects an outlet of the intermediate-pressure turbine 12 and low-pressure steam piping 33.

The steam generated in the steam generation device 20 is supplied to the steam turbine 10 through the steam piping 30 of the piping system 1000. At the time of start of the steam turbine plant 1 or at the time of an excessive increase in pressure in the steam piping 30, the steam flows in the bypass piping 40. The steam is supplied to the bypass piping 40 at the time of start of the steam turbine plant 1, thereby to improve starting performance of the steam turbine plant 1.

The steam piping 30 includes high-pressure steam piping 31 in which the steam to be supplied to the high-pressure turbine 11 flows, intermediate-pressure steam piping 32 in which the steam to be supplied to the intermediate-pressure turbine 12 flows, and the low-pressure steam piping 33 in which the steam to be supplied to the low-pressure turbine 13 flows. Note that the high-pressure steam piping 31 may be called main steam piping 31. The intermediate-pressure steam piping 32 may be called high-temperature reheat steam piping 32.

The high-pressure steam piping 31 is arranged to connect the high-pressure heating unit 21 and the high-pressure turbine 11. An end portion of the high-pressure steam piping 31 is connected with an inlet of the high-pressure turbine 11. The steam generated in the high-pressure heating unit 21 is supplied to the high-pressure turbine 11 through the high-pressure steam piping 31.

The intermediate-pressure steam piping 32 is arranged to connect the intermediate-pressure heating unit 22 and the intermediate-pressure turbine 12. An end portion of the intermediate-pressure steam piping 32 is connected with an inlet of the intermediate-pressure turbine 12. The steam generated in the reheating unit 24 is supplied to the intermediate-pressure turbine 12 through the intermediate-pressure steam piping 32.

The low-pressure steam piping 33 is arranged to connect the low-pressure heating unit 23 and the low-pressure turbine 13. An end portion of the low-pressure steam piping 33 is connected with an inlet of the low-pressure turbine 13. The steam generated in the low-pressure heating unit 23 is supplied to the low-pressure turbine 13 through the low-pressure steam piping 33.

The low-temperature reheat steam piping 51 is arranged to connect the outlet of the high-pressure turbine 11 and the reheating unit 24. In the present embodiment, the steam discharged through the outlet of the high-pressure turbine 11 is joined with the steam from the intermediate-pressure heating unit 22 and is then supplied to the reheating unit 24 through the low-temperature reheat steam piping 51. The reheating unit 24 heats the steam discharged from the high-pressure turbine 11 and supplied through the low-temperature reheat steam piping 51.

The bypass piping 40 includes high-pressure bypass piping 41 branching from the high-pressure steam piping 31, intermediate-pressure bypass piping 42 branching from the intermediate-pressure steam piping 32, and low-pressure bypass piping 43 branching from the low-pressure steam piping 33.

The high-pressure bypass piping 41 is arranged to connect the high-pressure steam piping 31 and the low-temperature reheat steam piping 51 (the outlet of the high-pressure turbine 11). The intermediate-pressure bypass piping 42 is arranged to connect the intermediate-pressure steam piping 32 and a condenser 2. The low-pressure bypass piping 43 is arranged to connect the low-pressure steam piping 33 and the condenser 2.

The piping system 1000 includes a plurality of valves. The valves include a steam stop valve 60 arranged in the steam piping 30, a control valve 70 arranged in the steam piping 30, a turbine bypass valve 80 arranged in the bypass piping 40, and a check valve 3 arranged in the low-temperature reheat steam piping 51.

Note that, in the following description, closing a passage of piping of the piping system 1000 by an operation of a valve is appropriately referred to as closing the valve, and opening a passage of piping of the piping system 1000 by an operation of a valve is appropriately referred to as opening the valve.

The steam stop valve 60 can intercept the passage of the steam piping 30 to stop the supply of the steam from the steam generation device 20 to the steam turbine 10. When the steam stop valve 60 is opened, the steam is supplied from the steam generation device 20 to the steam turbine 10. When the steam stop valve 60 is closed, the steam from the steam generation device 20 to the steam turbine 10 is stopped.

The steam stop valve 60 includes a high-pressure steam stop valve 61 arranged in the high-pressure steam piping 31, an intermediate-pressure steam stop valve 62 arranged in the intermediate-pressure steam piping 32, and a low-pressure steam stop valve 63 arranged in the low-pressure steam piping 33. Note that the high-pressure steam stop valve 61 may be called main steam stop valve 61. The intermediate-pressure steam stop valve 62 may be called reheat steam stop valve 62.

When the high-pressure steam stop valve 61 is opened, the steam is supplied from the high-pressure heating unit 21 to the high-pressure turbine 11. When the high-pressure steam stop valve 61 is closed, the supply of the steam from the high-pressure heating unit 21 to the high-pressure turbine 11 is stopped. When the intermediate-pressure steam stop valve 62 is opened, the steam is supplied from the intermediate-pressure heating unit 22 to the intermediate-pressure turbine 12. When the intermediate-pressure steam stop valve 62 is closed, the supply of the steam from the intermediate-pressure heating unit 22 to the intermediate-pressure turbine 12 is stopped. When the low-pressure steam stop valve 63 is opened, the steam is supplied from the low-pressure heating unit 23 to the low-pressure turbine 13. When the low-pressure steam stop valve 63 is closed, the supply of the steam from the low-pressure heating unit 23 to the low-pressure turbine 13 is stopped.

The control valve 70 can adjust the amount of the steam supplied from the steam generation device 20 to the steam turbine 10. The control valve 70 may be referred to as governor valve 70.

The control valve 70 includes a high-pressure control valve 71 arranged in the high-pressure steam piping 31, an intermediate-pressure control valve 72 arranged in the intermediate-pressure steam piping 32, and a low-pressure control valve 73 arranged in the low-pressure steam piping 33. Note that the high-pressure control valve 71 may be referred to as main control valve 71. The intermediate-pressure control valve 72 may be referred to as reheating control valve 72.

The turbine bypass valve 80 can open and close the passage of the bypass piping 40. When the turbine bypass valve 80 is opened, the steam from the steam generation device 20 can flow in the bypass piping 40. When the turbine bypass valve 80 is closed, circulation of the steam in the bypass piping 40 is intercepted.

The turbine bypass valve 80 includes a high-pressure turbine bypass valve 81 arranged in the high-pressure bypass piping 41, an intermediate-pressure turbine bypass valve 82 arranged in the intermediate-pressure bypass piping 42, and a low-pressure turbine bypass valve 83 arranged in the low-pressure bypass piping 43.

When the high-pressure turbine bypass valve 81 is opened, the steam from the high-pressure heating unit 21 can flow in the high-pressure bypass piping 41. When the high-pressure turbine bypass valve 81 is closed, circulation of the steam in the high-pressure bypass piping 41 is intercepted. When the intermediate-pressure turbine bypass valve 82 is opened, the steam from the reheating unit 24 can flow in the intermediate-pressure bypass piping 42. When the intermediate-pressure turbine bypass valve 82 is closed, circulation of the steam in the intermediate-pressure bypass piping 42 is intercepted. When the low-pressure turbine bypass valve 83 is opened, the steam from the low-pressure heating unit 23 can flow in the low-pressure bypass piping 43. When the low-pressure turbine bypass valve 83 is closed, circulation of the steam in the low-pressure bypass piping 43 is intercepted.

Figure 2:
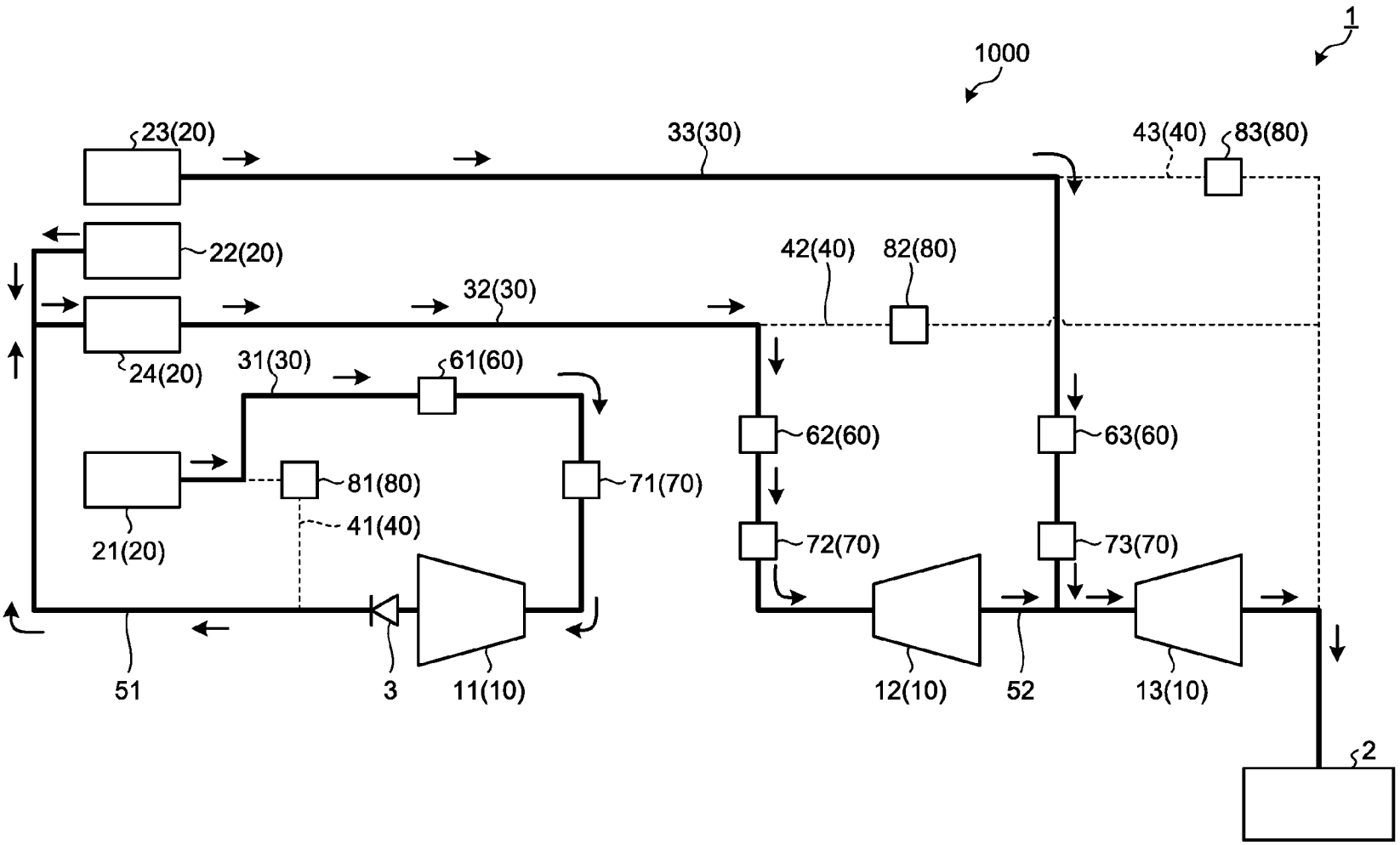
FIG. 2 is a diagram schematically illustrating an example of the steam turbine plant according to the first embodiment.

FIG. 2 is a diagram schematically illustrating a flow of the steam in the steam turbine plant 1 according to the present embodiment at the time of normal operation. At the time of normal operation, the high-pressure steam stop valve 61, the intermediate-pressure steam stop valve 62, and the low-pressure steam stop valve 63 are opened. The high-pressure turbine bypass valve 81, the intermediate-pressure turbine bypass valve 82, and the low-pressure turbine bypass valve 83 are closed.

The steam generated in the high-pressure heating unit 21 is supplied to the high-pressure turbine 11 through the high-pressure steam piping 31. The steam in the high-pressure steam piping 31 flows into the inlet of the high-pressure turbine 11. Accordingly, the high-pressure turbine 11 is operated. The steam flowing out through the outlet of the high-pressure turbine 11 is supplied to the reheating unit 24 through the low-temperature reheat steam piping 51.

The steam generated in the intermediate-pressure heating unit 22 is supplied to the reheating unit 24. The reheating unit 24 heats the steam supplied from the intermediate-pressure heating unit 22 and the steam supplied from the high-pressure turbine 11 through the low-temperature reheat steam piping 51. The steam reheated in the reheating unit 24 is supplied to the intermediate-pressure turbine 12 through the intermediate-pressure steam piping 32. The steam in the intermediate-pressure steam piping 32 flows into the inlet of the intermediate-pressure turbine 12. Accordingly, the intermediate-pressure turbine 12 is operated. The steam flowing out through the outlet of the intermediate-pressure turbine 12 is supplied to the low-pressure turbine 13 through the piping 52.

The steam generated in the low-pressure heating unit 23 is supplied to the low-pressure turbine 13 through the low-pressure steam piping 33. The steam in the low-pressure steam piping 33 flows into the inlet of the low-pressure turbine 13. In the present embodiment, the steam from the low-pressure heating unit 23 and the steam from the intermediate-pressure turbine 12 are supplied to the low-pressure turbine 13. Accordingly, the low-pressure turbine 13 is operated. The steam flowing out through an outlet of the low-pressure turbine 13 is supplied to the condenser 2. The condenser 2 returns the steam supplied from the low-pressure turbine 13 to water.

As illustrated in FIGS. 1 and 2, in the present embodiment, the piping system 1000 includes a piping member 100 including one inlet and two outlets. A junction between the high-pressure steam piping 31 and the high-pressure bypass piping 41 includes the piping member 100. A junction between the intermediate-pressure steam piping 32 and the intermediate-pressure bypass piping 42 includes the piping member 100. A junction between the low-pressure steam piping 33 and the low-pressure bypass piping 43 includes the piping member 100.

In the following description, the piping member 100 arranged in the junction between the high-pressure steam piping 31 and the high-pressure bypass piping 41 will be mainly described. The piping member 100 arranged in the junction between the intermediate-pressure steam piping 32 and the intermediate-pressure bypass piping 42, and the piping member 100 arranged in the junction between the low-pressure steam piping 33 and the low-pressure bypass piping 43 have a structure similar to that of the piping member 100 arranged in the junction between the high-pressure steam piping 31 and the high-pressure bypass piping 41.

Figure 3:
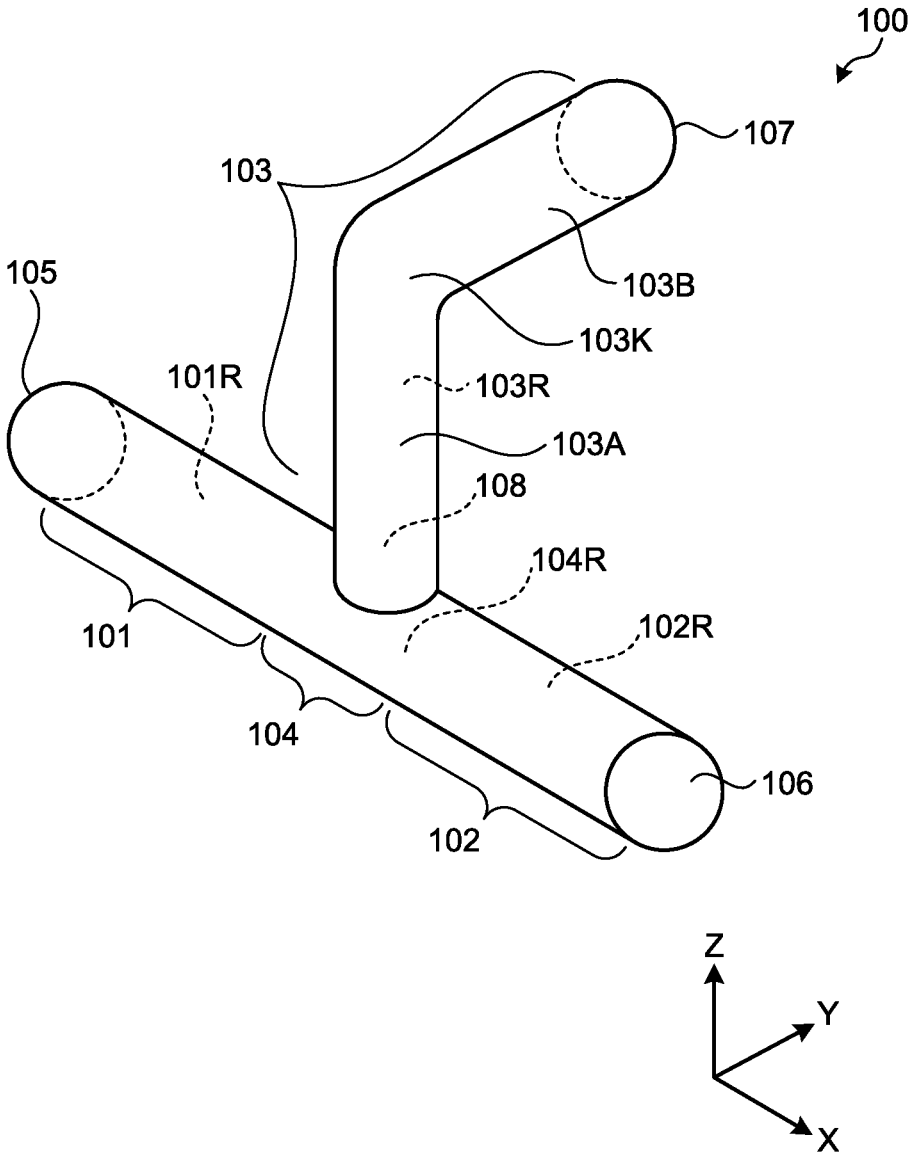
FIG. 3 is a perspective view illustrating an example of a piping member according to the first embodiment.
Figure 4:
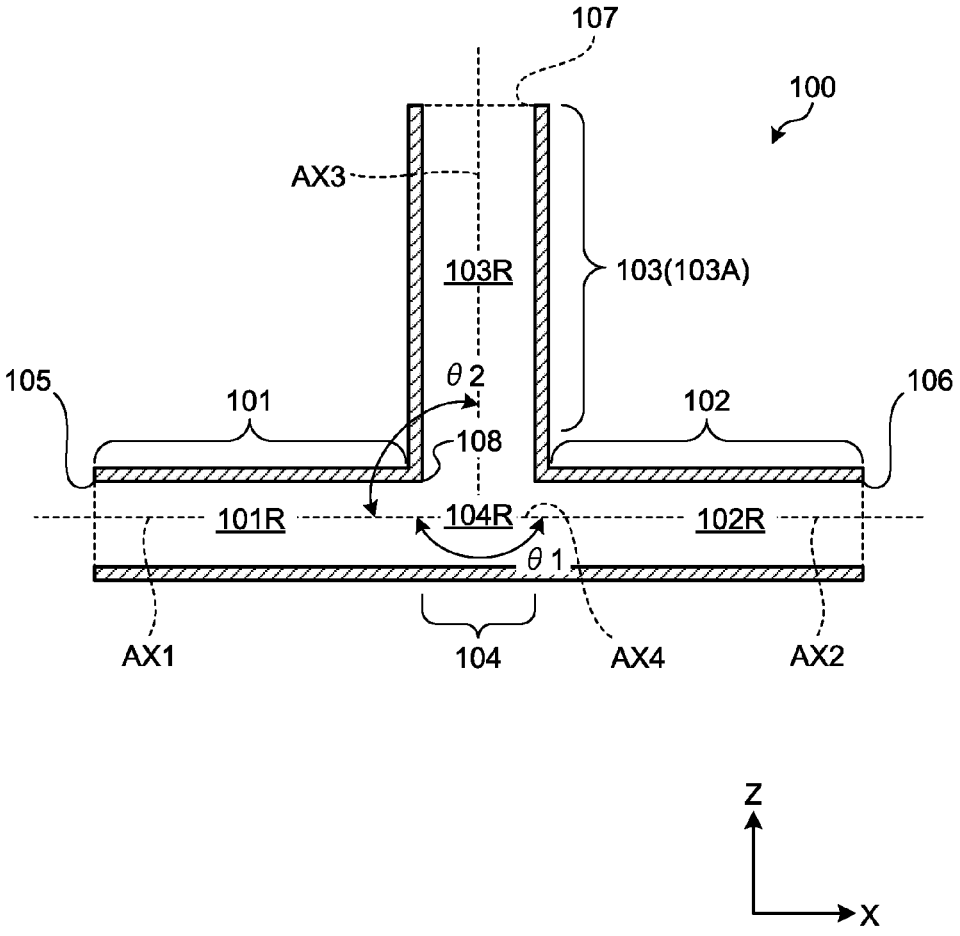
FIG. 4 is a sectional view illustrating an example of the piping member according to the first embodiment.

FIG. 3 is a perspective view illustrating an example of the piping member 100 according to the present embodiment. FIG. 4 is a sectional view illustrating an example of the piping member 100 according to the present embodiment.

In the following description, an XYZ rectangular coordinate system is set, and positional relationship among portions will be described with reference to the XYZ rectangular coordinate system. A direction parallel to an X axis in a horizontal plane is an X-axis direction, a direction parallel to a Y axis perpendicular to the X axis in the horizontal plane is a Y-axis direction, and a direction parallel to a Z axis perpendicular to the X axis and the Y axis is a Z-axis direction. The Z-axis direction is a vertical direction (up and down direction). An XY plane is parallel to the horizontal plane. The Z axis is perpendicular to the XY plane.

As illustrated in FIGS. 3 and 4, the piping member 100 includes a first pipe section 101, a second pipe section 102, a connection section 104 arranged between the first pipe section 101 and the second pipe section 102, and a third pipe section 103 connected with the connection section 104.

The first pipe section 101 includes a first passage 101R. The second pipe section 102 includes a second passage 102R. The connection section 104 includes a connection passage 104R that connects the first passage 101R and the second passage 102R.

The third pipe section 103 includes a third passage 103R. The third passage 103R is connected with the connection passage 104R through an opening 108. The first passage 101R, the second passage 102R, and the third passage 103R are connected through the connection passage 104R.

The piping member 100 includes an inlet 105 into which the steam flows, an outlet 106 out of which the steam flows, and an outlet 107 out of which the steam flows. The inlet 105 is provided in the first pipe section 101. The outlet 106 is provided in the second pipe section 102. The outlet 107 is provided in the third pipe section 103. The inlet 105 includes an opening provided in an end portion of the first pipe section 101. The outlet 106 includes an opening provided in an end portion of the second pipe section 102. The outlet 107 includes an opening provided in an end portion of the third pipe section 103.

In the present embodiment, the steam is supplied to the first pipe section 101. The steam flowing into the inlet 105 of the first pipe section 101 flows in the first passage 101R of the first pipe section 101, and then can flow into at least one of the second passage 102R of the second pipe section 102 and the third passage 103R of the third pipe section 103 through the connection passage 104R. The steam in the second passage 102R flows out through the outlet 106. The steam in the third passage 103R flows out through the outlet 107.

In the present embodiment, the first pipe section 101 is formed in a straight pipe shape. The second pipe section 102 is formed in a straight pipe shape. The third pipe section 103 includes a straight pipe section 103A connected to the connection section 104, a bent section 103K connected to the straight pipe section 103A, and a straight pipe section 103B connected to the bent section 103K. The bent section 103K is arranged between the straight pipe section 103A and the straight pipe section 103B.

The first pipe section 101 has a first central axis AX1. The first pipe section 101 is arranged around the first central axis AX1. The second pipe section 102 has a second central axis AX2. The second pipe section 102 is arranged around the second central axis AX2. The third pipe section 103 (straight pipe section 103A) includes a third central axis AX3. The third pipe section 103 (straight pipe section 103A) is arranged around the third central axis AX3. The connection section 104 includes a central axis AX4.

In the present embodiment, the shape of the first passage 101R in a plane perpendicular to the first central axis AX1 is a circle. The shape of the second passage 102R in a plane perpendicular to the second central axis AX2 is a circle. The shape of the third passage 103R in a plane perpendicular to the third central axis AX3 is a circle. An inner diameter (dimension) of the first passage 101R, an inner diameter (dimension) of the second passage 102R, and an inner diameter (dimension) of the third passage 103R are substantially equal.

As illustrated in FIG. 4, in the present embodiment, an angle θ1 made by the first central axis AX1 of the first pipe section 101 and the second central axis AX2 of the second pipe section 102 is larger than an angle θ2 made by the first central axis AX1 of the first pipe section 101 and the third central axis AX3 of the third pipe section 103 (straight pipe section 103A).

In the present embodiment, the first central axis AX1 and the second central axis AX2 are parallel. The first central axis AX1 and the second central axis AX2 coincide with each other (are the same axis).

In the present embodiment, the first central axis AX1, the second central axis AX2, and the central axis AX4 are parallel. The first central axis AX1, the second central axis AX2, and the central axis AX4 coincide with one another (are the same axis). That is, the first pipe section 101, the second pipe section 102, and the connection section 104 form a straight pipe.

In the present embodiment, the first central axis AX1 and the third central axis AX3 are perpendicular to each other.

That is, in the present embodiment, the angle θ1 is 180 [°]. The angle θ2 is 90 [°].

In the example illustrated in FIG. 4, the first central axis AX1 is parallel to the X axis. The second central axis AX2 is parallel to the X axis. The central axis AX4 is parallel to the X axis. The third central axis AX3 is parallel to the Z axis. The plane perpendicular to the first central axis AX1 is a YZ plane. The plane perpendicular to the second central axis AX2 is the YZ plane. The plane perpendicular to the third central axis AX3 is the XY plane.

Figure 5:
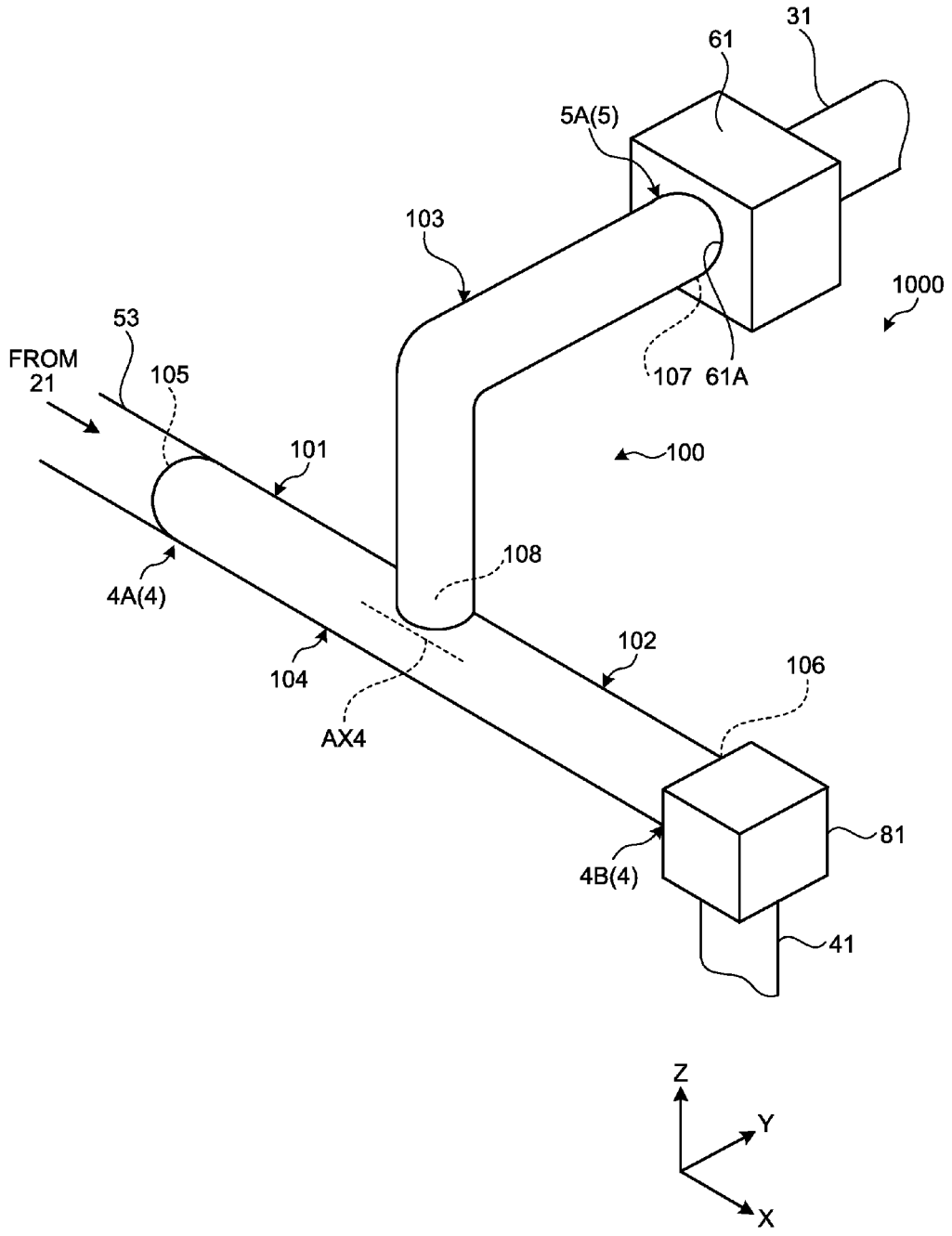
FIG. 5 is a perspective view schematically illustrating an example of a piping system according to the first embodiment.

FIG. 5 is a perspective view schematically illustrating a part of the piping system 1000 according to the present embodiment. FIG. 5 illustrates a perspective view of a vicinity of the piping member 100.

As illustrated in FIG. 5, in the present embodiment, the first pipe section 101 is connected with the high-pressure heating unit 21 through the supply piping 53. The supply piping 53 is arranged between the high-pressure heating unit 21 and the first pipe section 101. The steam generated in the high-pressure heating unit 21 is supplied to the first pipe section 101 through the supply piping 53.

The second pipe section 102 is connected with the high-pressure turbine bypass valve 81. The high-pressure turbine bypass valve 81 is arranged in the high-pressure bypass piping 41. The second pipe section 102 is connected with the high-pressure bypass piping 41 through the high-pressure turbine bypass valve 81. The steam in the second pipe section 102 is supplied to the high-pressure bypass piping 41 through the high-pressure turbine bypass valve 81. The steam in the second pipe section 102 flows into the inlet of the high-pressure turbine bypass valve 81.

The third pipe section 103 is connected with the high-pressure steam stop valve 61. The high-pressure steam stop valve 61 is arranged in the high-pressure steam piping 31. The third pipe section 103 is connected with the high-pressure steam piping 31 through the high-pressure steam stop valve 61. The high-pressure steam piping 31 is arranged between the third pipe section 103 and the high-pressure turbine 11. The steam in the third pipe section 103 is supplied to the high-pressure steam piping 31 through the high-pressure steam stop valve 61. The steam in the third pipe section 103 flows into an inlet 61A of the high-pressure steam stop valve 61.

In the present embodiment, the opening 108 is arranged above (in the +Z direction of) the central axis AX4 of the connection section 104. The inlet 61A of the high-pressure steam stop valve 61, into which the steam from the third pipe section 103 flows, is arranged above (in the +Z direction of) the central axis AX4 of the connection section 104. In the present embodiment, the inlet 61A is arranged above (in the +Z direction of) the opening 108.

The end portion of the first pipe section 101, in which the inlet 105 is provided, and the supply piping 53 are connected. The end portion of the second pipe section 102, in which the outlet 106 is provided, and the high-pressure bypass piping 41 are connected. The end portion of the third pipe section 103 (straight pipe section 103B), in which the outlet 107 is provided, and the high-pressure steam stop valve 61 are connected. In the present embodiment, the supply piping 53 and the first pipe section 101 are welded. The second pipe section 102 and the high-pressure bypass piping 41 are welded. The third pipe section 103 and the high-pressure steam stop valve 61 are welded.

Note that, in the present embodiment, the third pipe section 103 and the high-pressure steam stop valve 61 are directly welded. However, connection piping may be arranged between the third pipe section 103 and the high-pressure steam stop valve 61. The connection piping and the third pipe section 103 may be welded, and the connection piping and the high-pressure steam stop valve 61 may be welded. Further, in the present embodiment, the second pipe section 102 and the high-pressure turbine bypass valve 81 are directly welded. However, connection piping may be arranged between the second pipe section 102 and the high-pressure turbine bypass valve 81. The connection piping and the second pipe section 102 may be welded, and the connection piping and the high-pressure turbine bypass valve 81 may be welded.

Figure 6:
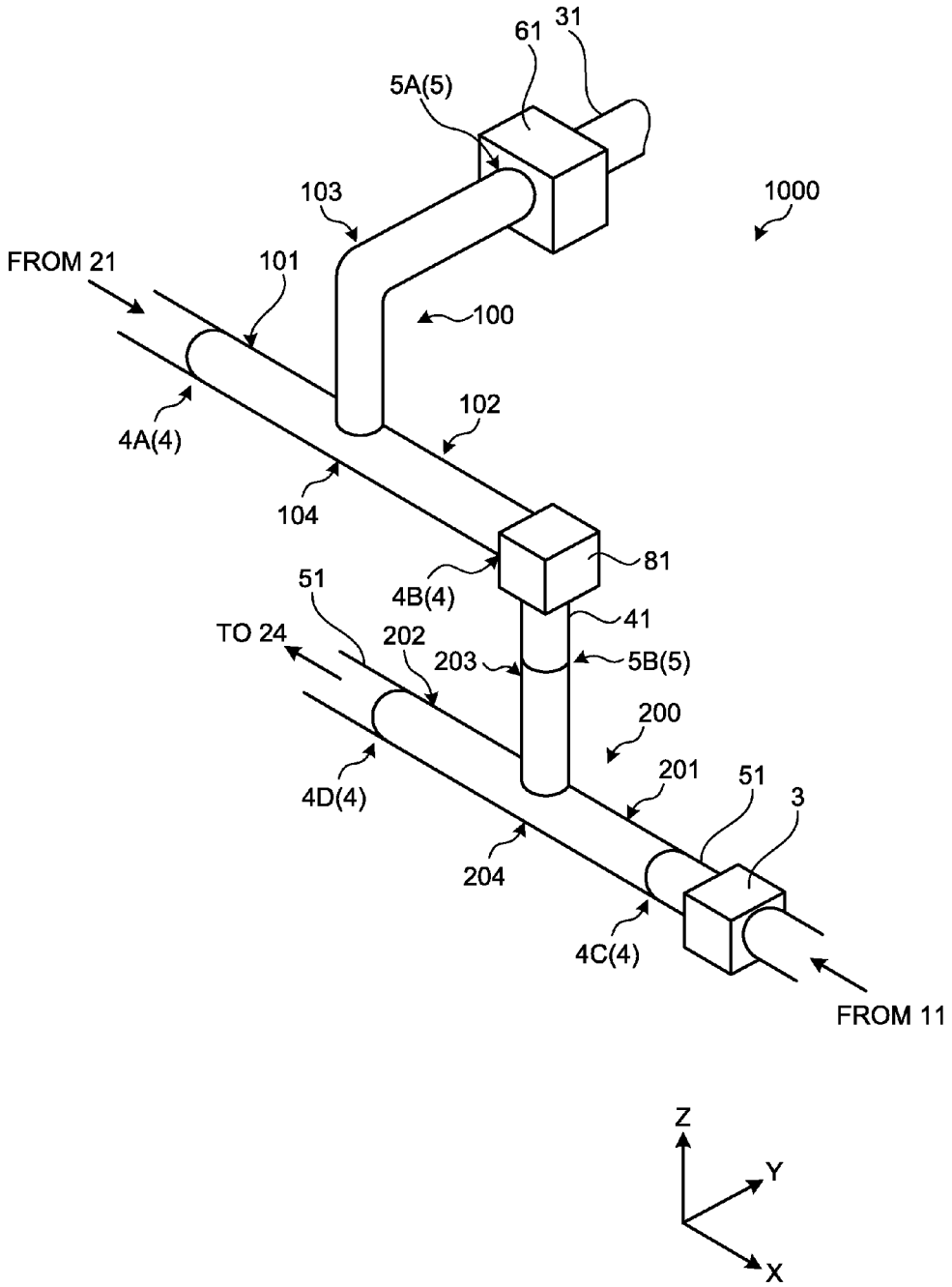
FIG. 6 is a perspective view schematically illustrating an example of the piping system according to the first embodiment.

FIG. 6 is a perspective view schematically illustrating a part of the piping system 1000 according to the present embodiment. As illustrated in FIG. 6, the piping system 1000 includes a piping member 200. The piping member 200 includes a pipe section 201 including a passage, a pipe section 202 including a passage, a connection section 204 arranged between the pipe section 201 and the pipe section 202 and including a connection passage that connects the passage of the pipe section 201 and the passage of the pipe section 202, and a pipe section 203 including a passage connected with the connection passage through an opening. The pipe section 201, the pipe section 202, and the connection section 204 form a straight pipe. The piping member 200 has a structure approximating to that of the piping member 100. Detailed description about the piping member 200 is omitted. In the example illustrated in FIG. 6, the pipe section 203 does not include a bent section. Note that the pipe section 203 may include a bent section.

The pipe section 201 is connected with the low-temperature reheat steam piping 51 in which the check valve 3 is arranged. The pipe section 202 is connected with the low-temperature reheat steam piping 51 connected with the reheating unit 24. The pipe section 203 is connected with the high-pressure bypass piping 41 in which the high-pressure turbine bypass valve 81 is arranged.

The steam discharged from the high-pressure turbine 11 is supplied to the pipe section 201. The steam in the high-pressure bypass piping 41 is supplied to the pipe section 203. When the high-pressure turbine bypass valve 81 is opened, the steam from the high-pressure heating unit 21 flows into the high-pressure bypass piping 41 through the first pipe section 101 and the second pipe section 102 of the piping member 100. When the high-pressure turbine bypass valve 81 is opened, the steam from the high-pressure heating unit 21 is supplied to the pipe section 203. When the high-pressure turbine bypass valve 81 is closed, the steam from the high-pressure heating unit 21 is not supplied to the pipe section 203.

The steam in the pipe section 201 can flow into the pipe section 202. The steam in the pipe section 203 can flow into the pipe section 202. The steam in the pipe section 202 is supplied to the reheating unit 24 through the low-temperature reheat steam piping 51. The reheating unit 24 heats the steam from the low-temperature reheat steam piping 51.

In the present embodiment, the supply piping 53 and the first pipe section 101 are welded by first welding treatment. The second pipe section 102 and the high-pressure bypass piping 41 are welded by the first welding treatment. The third pipe section 103 and the high-pressure steam stop valve 61 are welded by second welding treatment.

The low-temperature reheat steam piping 51 and the pipe section 201 are welded by the first welding treatment. The pipe section 202 and the low-temperature reheat steam piping 51 are welded by the first welding treatment. The high-pressure bypass piping 41 and the pipe section 203 are welded by the second welding treatment.

In the following description, a welded portion generated by the first welding treatment is appropriately referred to as first welded portion 4, and a welded portion generated by the second welding treatment is appropriately referred to as second welded portion 5.

In the present embodiment, the first welded portion 4 includes a first welded portion 4A between the supply piping 53 and the first pipe section 101, and a first welded portion 4B between the second pipe section 102 and the high-pressure bypass piping 41. Further, the first welded portion 4 includes a first welded portion 4C between the low-temperature reheat steam piping 51 and the pipe section 201, and a first welded portion 4D between the pipe section 202 and the low-temperature reheat steam piping 51.

The second welded portion 5 includes a second welded portion 5A between the third pipe section 103 and the high-pressure steam stop valve 61. Further, the second welded portion 5 includes a second welded portion 5B between the high-pressure bypass piping 41 in which the high-pressure turbine bypass valve 81 is arranged and the pipe section 203.

The first welding treatment includes groove welding. The second welding treatment includes groove welding. The first welding treatment includes welding in which foreign substances such as welding slag occurs. The second welding treatment includes welding in which foreign substances such as welding slag occurs.

Figure 7:
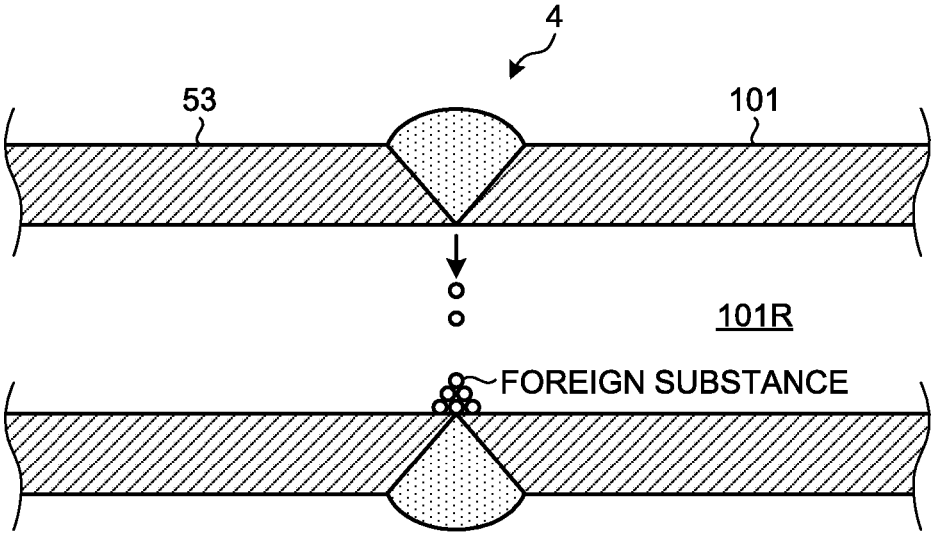
FIG. 7 is a sectional view of an enlarged part of piping of the piping system according to the first embodiment.

FIG. 7 is a sectional view schematically illustrating an example of the first welded portion 4. As illustrated in FIG. 7, there is a possibility of foreign substances occurring due to the first welding treatment and remaining in an inside of the piping (for example, the first passage 101R of the first pipe section 101).

Figure 8:
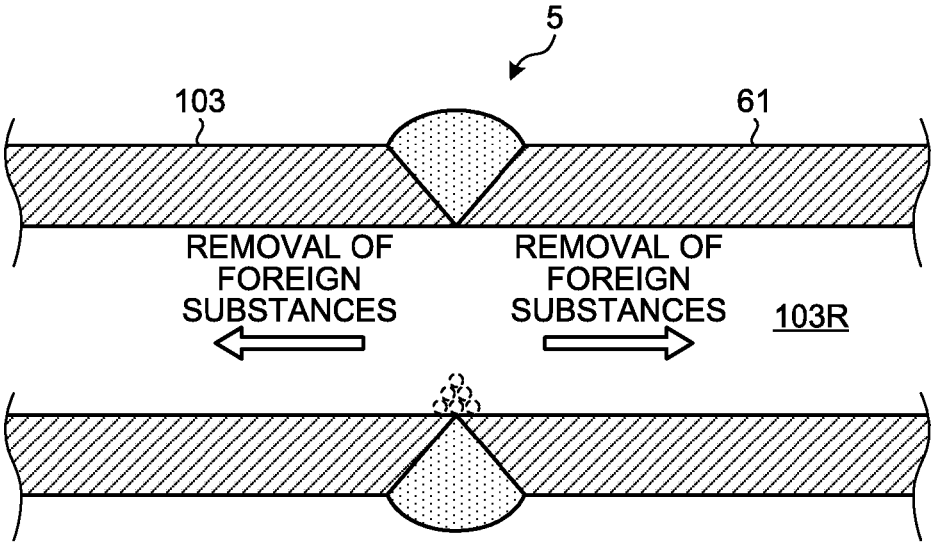
FIG. 8 is a sectional view of an enlarged part of piping of the piping system according to the first embodiment.

FIG. 8 is a sectional view schematically illustrating an example of the second welded portion 5. The second welding treatment includes processing of removing the foreign substances such as welding slag from the inside of the piping by a worker after welding treatment similar to the first welding treatment is performed. The second welding treatment requires the worker to access the welded portion from the inside of the piping. Therefore, the second welding treatment is applied to a limited extent. Note that the second welding treatment is not limited to this aspect, and a method that does not generate the foreign substances inside the piping may be employed, without performing the removal of the foreign substances from the inside of the piping. Further, in the present embodiment, the third pipe section 103 and the high-pressure steam stop valve 61 are connected by the second welding treatment. However, the method of connecting the third pipe section 103 and the high-pressure steam stop valve 61 is not limited to the second welding treatment as long as the connection method does not generate the foreign substances inside the piping, and for example, a connection method of fastening a flange with a bolt may be employed.

Next, blowing out according to the present embodiment will be described. For example, before the start of the steam turbine plant 1 after completion of construction for building the steam turbine plant 1, blowing out (flushing) of removing the foreign substances in the piping of the piping system 1000 is conducted.

The construction for building the steam turbine plant 1 includes the first welding treatment and the second welding treatment. As described above, there is a possibility of the foreign substances occurring due to the first welding treatment and remaining inside the piping. Further, the first welded portion 4 may be polished or cut by a grinder. There is also a possibility of occurrence of the foreign substances due to the polishing or cutting.

The blowing out is processing of removing the foreign substances inside the piping. Note that the blowing out may be conducted before restart of the steam turbine plant 1 after stop of the steam turbine plant 1 for a long period of time.

The blowing out includes processing of supplying steam to the piping of the piping system 1000. The foreign substances in the piping are blown out by the steam supplied to the piping. Accordingly, the foreign substances in the piping are removed. The steam supplied to the piping in the blowing out is free-blown (released into the atmosphere).

In the present embodiment, the blowing out is conducted by supply of the steam from the high-pressure heating unit 21 to the piping system 1000.

Figure 9:
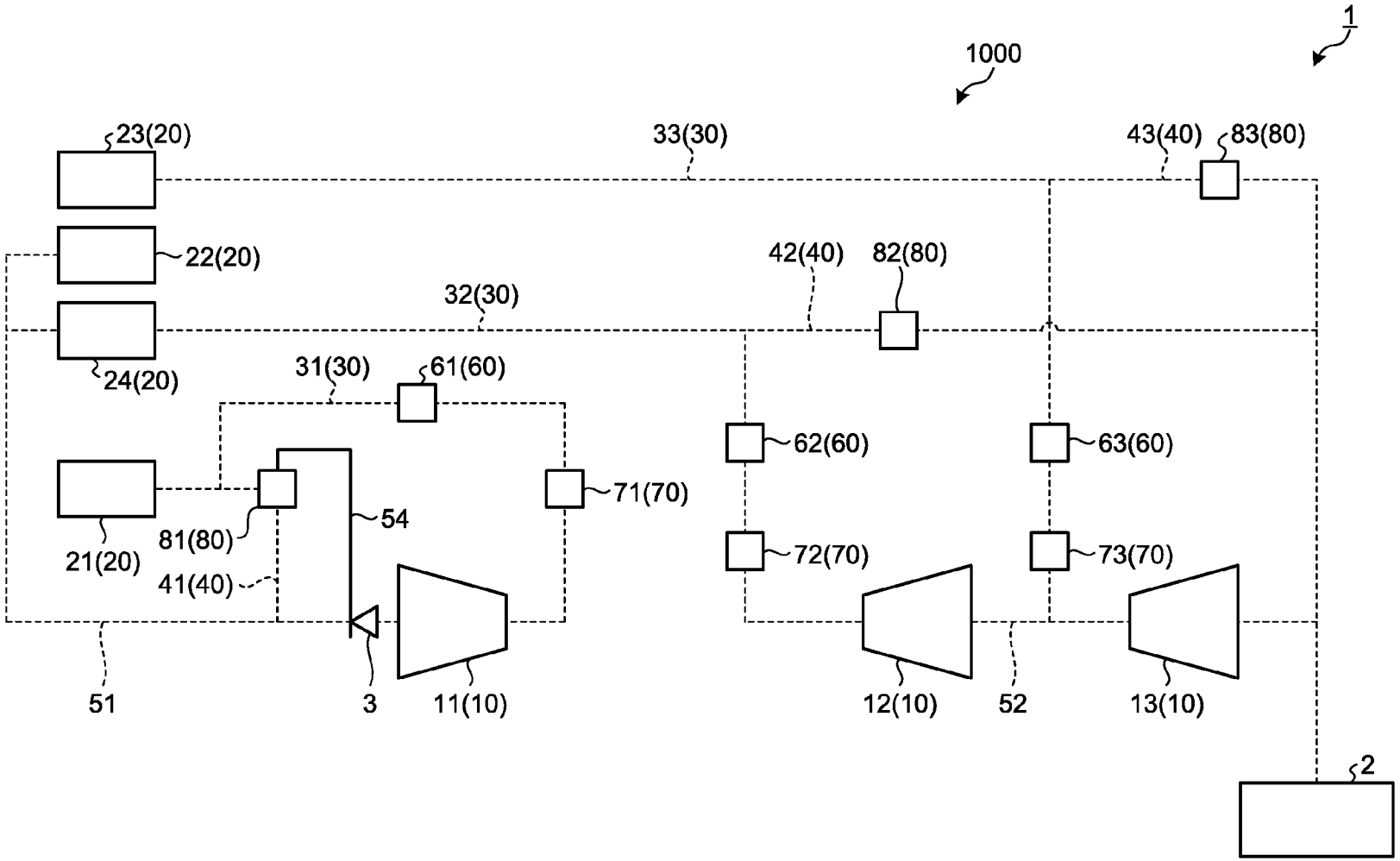
FIG. 9 is a diagram schematically illustrating an example of the steam turbine plant according to the first embodiment.

FIG. 9 is a diagram schematically illustrating an example of the steam turbine plant 1 when the blowing out according to the present embodiment is conducted. As illustrated in FIG. 9, in the present embodiment, the blowing out is conducted in a state where the high-pressure turbine bypass valve 81 and the low-temperature reheat steam piping (reheating piping) 51 are connected through temporary piping 54. In the present embodiment, one end portion of the temporary piping 54 is connected to the high-pressure turbine bypass valve 81, and the other end portion of the temporary piping 54 is connected to the check valve 3. The check valve 3 is arranged in the low-temperature reheat steam piping 51. When the other end portion of the temporary piping 54 is connected with the check valve 3, the temporary piping 54 is connected with the low-temperature reheat steam piping 51.

Figure 10:
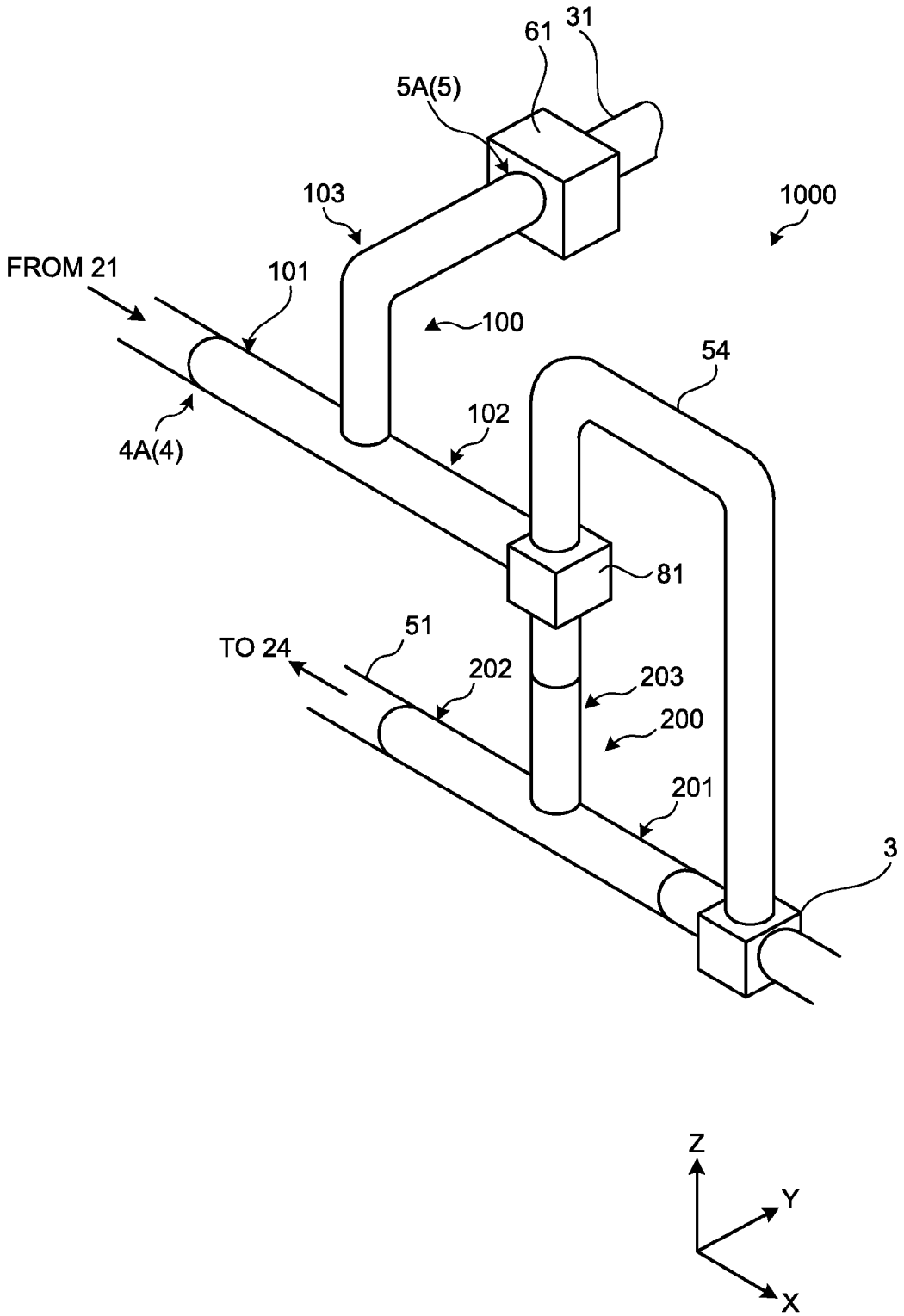
FIG. 10 is a perspective view schematically illustrating an example of the piping system according to the first embodiment.

FIG. 10 is a perspective view schematically illustrating a part of the piping system 1000 when the blowing out according to the present embodiment is conducted. As illustrated in FIG. 10, the high-pressure turbine bypass valve 81 (high-pressure bypass piping 41) and the check valve 3 (low-temperature reheat steam piping 51) are connected through the temporary piping 54.

Figure 11:
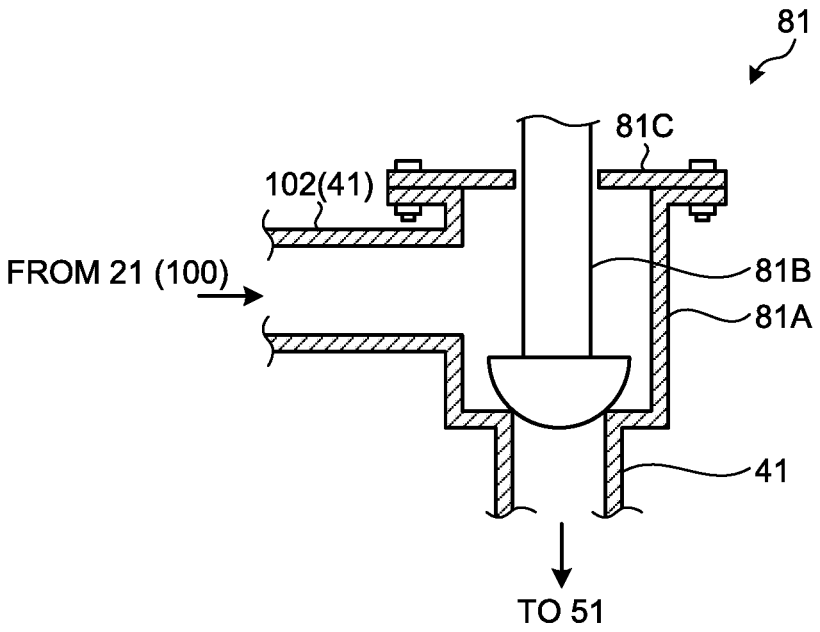
FIG. 11 is a sectional view schematically illustrating an example of a high-pressure turbine bypass valve according to the first embodiment.

FIG. 11 is a sectional view schematically illustrating an example of the high-pressure turbine bypass valve 81 according to the present embodiment. As illustrated in FIG. 11, the high-pressure turbine bypass valve 81 includes a housing 81A, a valve body 81B, at least a part of which is arranged in an internal space of the housing 81A, and a cover member 81C that blocks an opening of the housing 81A. The cover member 81C is fixed to the housing 81A with a bolt member.

The passage of the high-pressure bypass piping 41 is connected with the internal space of the housing 81A. The steam having been sent out from the high-pressure heating unit 21 and passed through the first pipe section 101 and the second pipe section 102 of the piping member 100 flows into the internal space of the housing 81A. The valve body 81B can open and close the passage of the high-pressure bypass piping 41 communicating with the low-temperature reheat steam piping 51. When the passage is closed by the valve body 81B, the steam from the high-pressure heating unit 21 is not supplied to the low-temperature reheat steam piping 51. When the passage is opened by the valve body 81B, the steam from the high-pressure heating unit 21 is supplied to the low-temperature reheat steam piping 51.

Figure 12:
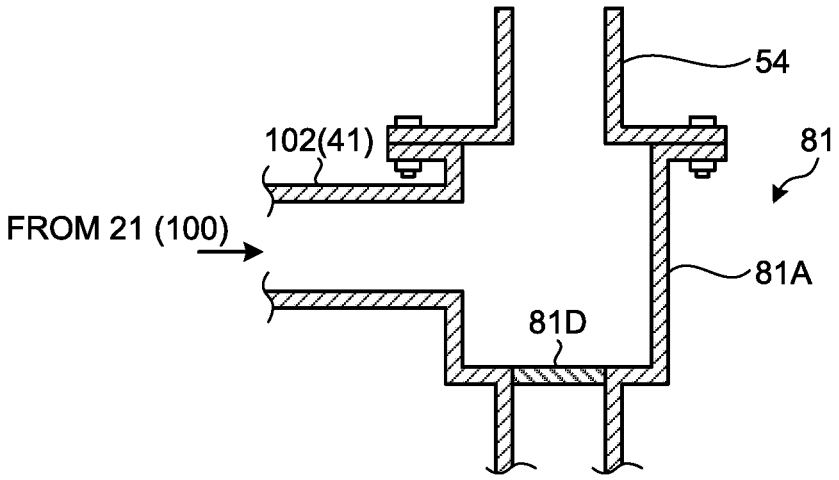
FIG. 12 is a sectional view schematically illustrating an example of a state in which the high-pressure turbine bypass valve according to the first embodiment is disassembled.

FIG. 12 is a sectional view illustrating an example of a state in which the high-pressure turbine bypass valve 81 and the temporary piping 54 according to the present embodiment are connected. As described above, in the blowing out, the high-pressure turbine bypass valve 81 and the temporary piping 54 are connected. In the present embodiment, when the temporary piping 54 is connected to the high-pressure turbine bypass valve 81, the high-pressure turbine bypass valve 81 is disassembled. That is, the valve body 81B and the cover member 81C are detached from the housing 81A. In the state where the valve body 81B and the cover member 81C are detached from the housing 81A, the housing 81A and the second pipe section 102 (high-pressure bypass piping 41) are connected, and the housing 81A and the temporary piping 54 are connected. The temporary piping 54 is fixed to the housing 81A with a bolt member.

Further, in the blowing out, the passage of the high-pressure bypass piping 41 communicating with the low-temperature reheat steam piping 51 is blocked by a blocking member 81D. Accordingly, the steam from the high-pressure heating unit 21 is sent to the temporary piping 54 without being sent to the low-temperature reheat steam piping 51 through the high-pressure bypass piping 41.

Figure 13:
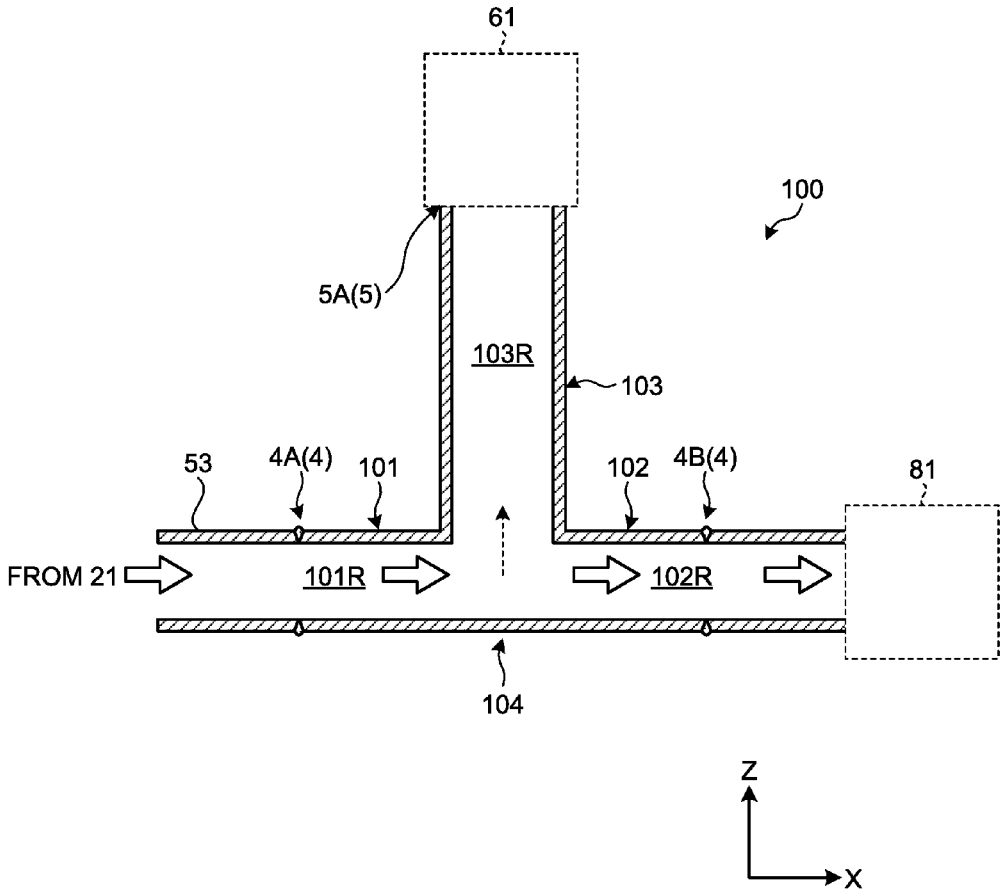
FIG. 13 is a diagram for describing an example of blowing out according to the first embodiment.

FIG. 13 is a sectional view illustrating an example of the blowing out according to the present embodiment. In the present embodiment, the steam is supplied from the high-pressure heating unit 21 in the blowing out. The steam sent out from the high-pressure heating unit 21 passes through the passage of the supply piping 53, and is then supplied to the first pipe section 101. The supply piping 53 and the first pipe section 101 are welded by the first welding treatment. Therefore, a possibility of existence of the foreign substances in the passage of the supply piping 53 or in the first passage 101R of the first pipe section 101 is high. The foreign substances in the passage of the supply piping 53 are discharged from the passage of the supply piping 53 by the steam supplied from the high-pressure heating unit 21. The foreign substances in the first passage 101R of the first pipe section 101 are discharged from the first passage 101R by the steam supplied from the high-pressure heating unit 21.

In the present embodiment, the blowing out is conducted in a state where the high-pressure steam stop valve 61 connected to the third pipe section 103 is closed.

Therefore, inflow of the steam sent out from the high-pressure heating unit 21 into the high-pressure steam piping 31 is suppressed. Accordingly, movement of the foreign substances from the first passage 101R into the high-pressure steam piping 31, and movement of the foreign substances into the high-pressure turbine 11 through the high-pressure steam piping 31 are suppressed.

Further, in the present embodiment, the angle θ1 made by the first central axis AX1 and the second central axis AX2 is larger than the angle θ2 made by the first central axis AX1 and the third central axis AX3 in the piping member 100.

Therefore, the foreign substances moved together with the steam flow principally into the second pipe section 102 due to inertia. In other words, the amount of the foreign substances moved from the first passage 101R to the third passage 103R is smaller than the amount of the foreign substances moved from the first passage 101R to the second passage 102R. That is, the movement (inflow) of the foreign substances from the first passage 101R into the third passage 103R is suppressed.

In the present embodiment, the angle θ1 is 180 [°], and the first pipe section 101, the connection section 104, and the second pipe section 102 form a straight pipe. The angle θ2 is 90 [°]. Therefore, the movement of the foreign substances from the first passage 101R into the third passage 103R is sufficiently suppressed.

The steam supplied from the first passage 101R to the second passage 102R discharges the foreign substances in the second passage 102R from the second passage 102R. The second pipe section 102 and the high-pressure bypass piping 41 are welded by the first welding treatment. Therefore, a possibility of existence of the foreign substances in the second passage 102R of the second pipe section 102 or in the passage of the high-pressure bypass piping 41 is high. The foreign substances in the second passage 102R of the second pipe section 102 are discharged from the second passage 102R by the steam supplied from the high-pressure heating unit 21 through the first passage 101R. Further, the foreign substances in the passage of the high-pressure bypass piping 41 are discharged from the passage of the high-pressure bypass piping 41 by the steam supplied from the high-pressure heating unit 21 through the first passage 101R of the first pipe section 101.

Figure 14:
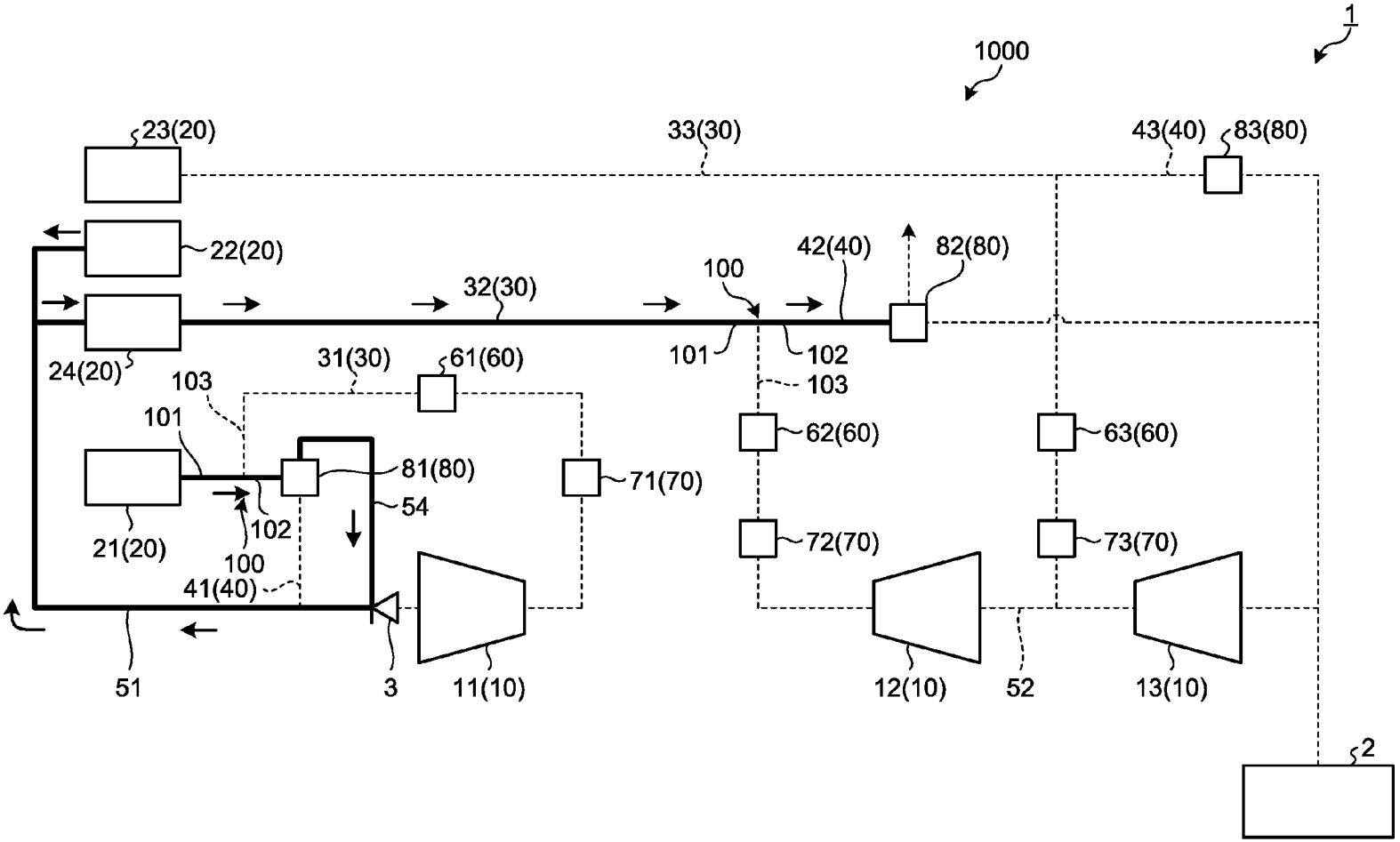
FIG. 14 is a diagram for describing an example of the blowing out according to the first embodiment.

FIG. 14 is a diagram for describing an example of the blowing out according to the present embodiment. As illustrated in FIG. 14, the steam sent out from the high-pressure heating unit 21 is supplied to the first pipe section 101 of the piping member 100 through the supply piping 53. Since the high-pressure steam stop valve 61 connected to the third pipe section 103 of the piping member 100 is closed, the steam supplied to the first pipe section 101 is entirely discharged from the second pipe section 102. The steam discharged from the second pipe section 102 flows into the internal space of the housing 81A of the high-pressure turbine bypass valve 81.

As described with reference to FIG. 12, in the blowing out, the housing 81A of the high-pressure turbine bypass valve 81 and the temporary piping 54 are connected. Further, the passage of the high-pressure bypass piping 41 communicating with the low-temperature reheat steam piping 51 is blocked by the blocking member 81D. Accordingly, the steam flowing into the internal space of the high-pressure turbine bypass valve 81 from the second pipe section 102 flows into the passage of the temporary piping 54.

The other end portion of the temporary piping 54 is connected to the check valve 3 (low-temperature reheat steam piping 51). The steam in the temporary piping 54 is supplied to the passage of the low-temperature reheat steam piping 51 through the check valve 3.

The steam from the temporary piping 54 and the check valve 3 is supplied to the pipe section 201 of the piping member 200. The steam supplied to the pipe section 201 flows in the pipe section 201, and is then supplied to the low-temperature reheat steam piping 51. The steam in the low-temperature reheat steam piping 51 is supplied to the reheating unit 24 and the intermediate-pressure heating unit 22.

The steam supplied to the reheating unit 24 is supplied to the intermediate-pressure steam piping 32. The steam in the intermediate-pressure steam piping 32 is supplied to the intermediate-pressure turbine bypass valve 82 through the intermediate-pressure bypass piping 42.

As described above, the piping member 100 is arranged in the junction between the intermediate-pressure steam piping 32 and the intermediate-pressure bypass piping 42. The first pipe section 101 of the piping member 100 is connected with the intermediate-pressure steam piping 32 by the first welding treatment. The second pipe section 102 of the piping member 100 is connected with the intermediate-pressure turbine bypass valve 82 (intermediate-pressure bypass piping 42) by the first welding treatment. The third pipe section 103 of the piping member 100 is connected with the intermediate-pressure steam stop valve 62 by the second welding treatment.

In the present embodiment, the blowing out is performed in a state where the intermediate-pressure steam stop valve 62 connected to the third pipe section 103 is closed.

Therefore, inflow of the steam from the reheating unit 24 into the intermediate-pressure steam piping 32 between the intermediate-pressure steam stop valve 62 and the intermediate-pressure turbine 12 is suppressed. Accordingly, the movement of the foreign substances from the first passage 101R into the intermediate-pressure turbine 12 through the intermediate-pressure steam piping 32 is suppressed.

Further, in the present embodiment, the angle θ1 made by the first central axis AX1 and the second central axis AX2 is larger than the angle θ2 made by the first central axis AX1 and the third central axis AX3 in the piping member 100.

Therefore, the foreign substances moved together with the steam flow principally into the second pipe section 102 due to inertia. In other words, the amount of the foreign substances moved from the first passage 101R to the third passage 103R is smaller than the amount of the foreign substances moved from the first passage 101R to the second passage 102R. That is, the movement (inflow) of the foreign substances from the first passage 101R into the third passage 103R is suppressed.

In the present embodiment, the steam is free-blown (released into the atmosphere) through the intermediate-pressure turbine bypass valve 82. An emission pipe is connected to the intermediate-pressure turbine bypass valve 82. A blowing-out determination target and a silencer are arranged in the emission pipe. The steam supplied to the intermediate-pressure turbine bypass valve 82 is free-blown through the emission pipe.

That is, in the present embodiment, the steam sent out from the high-pressure heating unit 21 passes through the first pipe section 101 and the second pipe section 102 of the piping member 100, the temporary piping 54, the pipe section 201 and the pipe section 202 of the piping member 200, the low-temperature reheat steam piping 51, and the intermediate-pressure steam piping 32. Accordingly, the foreign substances in the first pipe section 101, the second pipe section 102, the pipe section 202, the pipe section 203, the low-temperature reheat steam piping 51, and the intermediate-pressure steam piping 32 are removed.

In the present embodiment, the high-pressure steam stop valve 61 is closed, and inflow of the steam into the third pipe section 103 of the piping member 100 and the high-pressure steam piping 31 is suppressed in the blowing out. Further, the third pipe section 103 and the high-pressure steam stop valve 61 are welded by the second welding treatment. Therefore, a possibility of existence of the foreign substances in the third passage 103R is low.

Further, the piping member 100 is connected (welded) with the supply piping 53, the high-pressure turbine bypass valve 81 (high-pressure bypass piping 41), and the high-pressure steam stop valve 61 after sufficiently cleaned. For example, in a manufacturing factory of the piping member 100 (piping member maker), after an inner surface of the passage of the piping member 100 (an inner surface of the first pipe section 101, an inner surface of the second pipe section 102, an inner surface of the third pipe section 103, and an inner surface of the connection section 104) is sufficiently cleaned, the cleaned piping member 100 is delivered to the steam turbine plant 1. A possibility of the foreign substances remaining in the first passage 101R of the first pipe section 101 and the second passage 102R of the second pipe section 102 due to the first welding treatment between the first pipe section 101 and the supply piping 53 and the first welding treatment between the second pipe section 102 and the high-pressure bypass piping 41 is high. The foreign substances are removed by the blowing out according to the present embodiment. A possibility of the foreign substances remaining in the third passage 103R of the third pipe section 103 welded by the second welding treatment is low. Therefore, by suppressing inflow of the steam into the third passage 103R of the third pipe section 103, the steam having been sent out from the high-pressure heating unit 21 and having passed through the first passage 101R, contamination of the third pipe section 103 is suppressed. Further, in the present embodiment, since the angle θ1 is larger than the angle θ2, the inflow of the foreign substances from the first passage 101R of the first pipe section 101 into the third passage 103R of the third pipe section 103 is suppressed.

Further, inflow of the steam having passed through the first passage 101R into the third passage 103R is suppressed, and thus not only the contamination of the third pipe section 103, but also contamination of the high-pressure steam stop valve 61 is suppressed. Further, since the steam is supplied to the first passage 101R of the first pipe section 101 in the state where the high-pressure steam stop valve 61 is closed, inflow of the steam (foreign substances) from the first passage 101R into the high-pressure steam piping 31 between the high-pressure steam stop valve 61 and the high-pressure turbine 11 is suppressed.

Similarly to the piping member 100, the piping member 200 is also delivered in a sufficiently cleaned state. The piping member 200 is connected (welded) with the low-temperature reheat steam piping 51 and the high-pressure bypass piping 41 after sufficiently cleaned. A possibility of the foreign substances remaining in the passage of the pipe section 201 and the passage of the pipe section 202 due to the first welding treatment between the pipe section 201 and the low-temperature reheat steam piping 51 and the first welding treatment between the pipe section 202 and the low-temperature reheat steam piping 51 is high. The foreign substances are removed by the blowing out according to the present embodiment. A possibility of the foreign substances remaining in the passage of the pipe section 203 welded by the second welding treatment is low. Therefore, by suppressing inflow of the steam into the passage of the pipe section 203, the steam having been supplied to the passage of the pipe section 201 through the temporary piping 54, and having passed through the passage of the pipe section 201, contamination of the pipe section 203 is suppressed. In the present embodiment, the piping member 200 has a structure approximating to that of the piping member 100. Therefore, inflow of the steam from the temporary piping 54 into the passage of the pipe section 203 is suppressed.

Further, in the present embodiment, the piping member 100 is arranged in the junction between the intermediate-pressure steam piping 32 and the intermediate-pressure bypass piping 42. The steam is sent out from the reheating unit 24 in the state where the intermediate-pressure steam stop valve 62 is closed, and the blowing out is conducted. Accordingly, movement of the foreign substances into the intermediate-pressure turbine 12 side is suppressed.

Further, in the present embodiment, the piping member 100 is arranged in the junction between the low-pressure steam piping 33 and the low-pressure bypass piping 43. The first pipe section 101 of the piping member 100 is connected with the low-pressure steam piping 33 by the first welding treatment. The second pipe section 102 of the piping member 100 is connected with the low-pressure turbine bypass valve 83 (low-pressure bypass piping 43) by the first welding treatment. The third pipe section 103 of the piping member 100 is connected with the low-pressure steam stop valve 63 by the second welding treatment. The blowing out may be conducted as the steam is sent out from the low-pressure heating unit 23 in the state where the low-pressure steam stop valve 63 connected to the third pipe section 103 is closed. Accordingly, movement of the foreign substances into the low-pressure turbine 13 side is suppressed.

Figure 15:
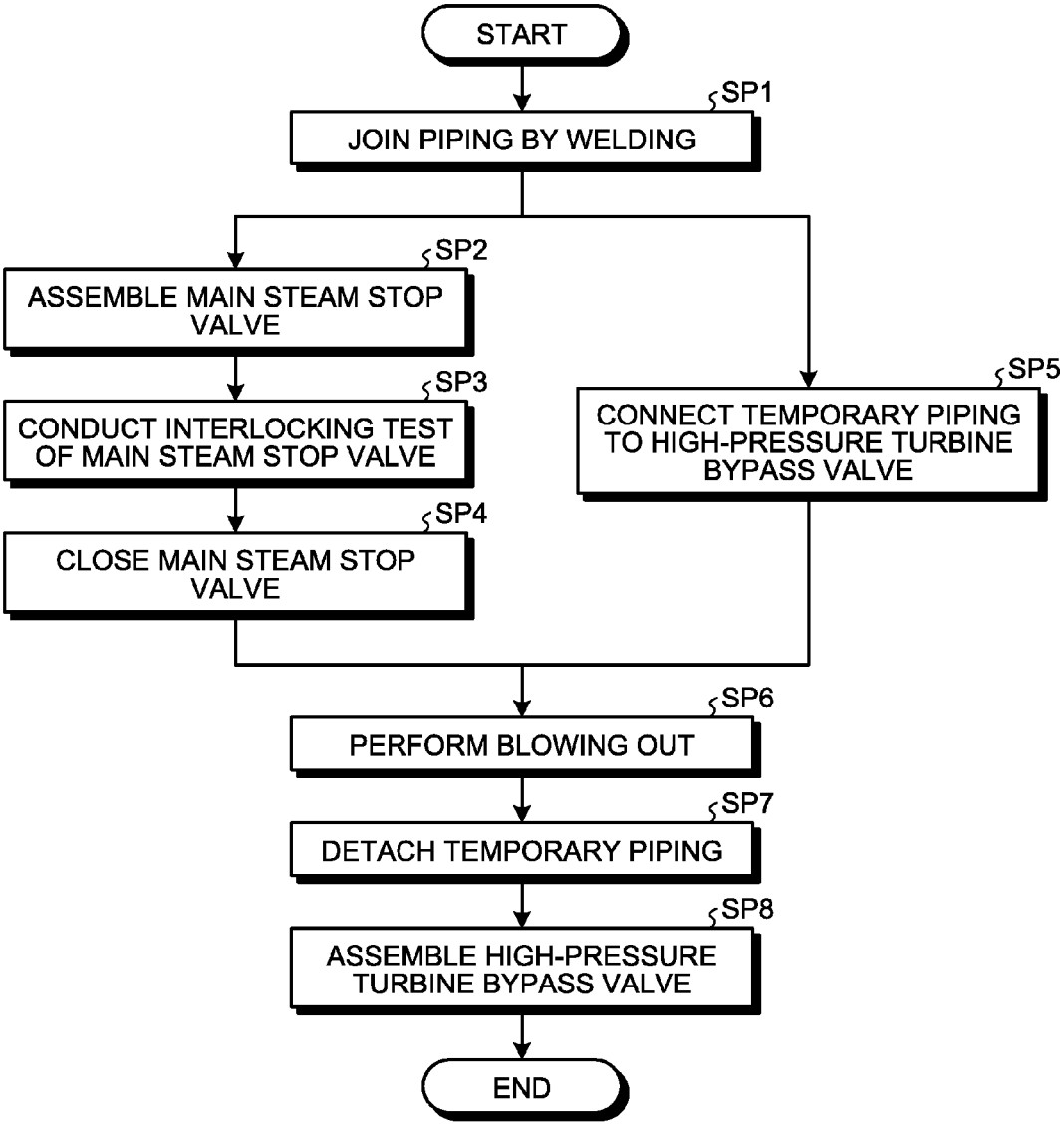
FIG. 15 is a flowchart illustrating an example of a method of cleaning a piping system according to the first embodiment.

Next, a method of cleaning the piping system 1000 according to the present embodiment will be described with reference to FIG. 15. FIG. 15 is a flowchart illustrating an example of the method of cleaning the piping system 1000 according to the present embodiment.

The piping member 100 and the piping member 200 are delivered from the piping member maker to the steam turbine plant 1. As described above, the piping member 100 including the first pipe section 101, the second pipe section 102, the third pipe section 103, and the connection section 104 is cleaned before the delivery. The piping member 200 including the pipe section 201, the pipe section 202, the pipe section 203, and the connection section 204 is cleaned before the delivery.

The piping member 100, and the high-pressure heating unit 21 (supply piping 53), the high-pressure turbine bypass valve 81 (high-pressure bypass piping 41), and the high-pressure steam stop valve 61 are joined by welding (step SP1). The cleaned first pipe section 101, and the supply piping 53 connected to the high-pressure heating unit 21 of the steam generation device 20 are connected by the first welding treatment. The cleaned second pipe section 102 and the high-pressure bypass piping 41 are connected by the first welding treatment. The cleaned third pipe section 103 and the high-pressure steam stop valve 61 arranged in the high-pressure steam piping 31 connected to the inlet of the high-pressure turbine 11 are connected by the second welding treatment.

In the present embodiment, work to connect the second pipe section 102 and the high-pressure turbine bypass valve 81 is conducted in the state where the high-pressure turbine bypass valve 81 is disassembled. That is, the work to connect the second pipe section 102 and the high-pressure bypass piping 41 by the first welding treatment is conducted in the state where the high-pressure turbine bypass valve 81 is disassembled. As described with reference to FIG. 12 and the like, the state where the high-pressure turbine bypass valve 81 is disassembled refers to the state in which the valve body 81B and the cover member 81C are detached from the housing 81A.

The high-pressure steam stop valve 61 is assembled, and the high-pressure steam stop valve 61 is arranged in the high-pressure steam piping 31 (step SP2).

A test of the high-pressure steam stop valve 61 is conducted (step SP3). The test of the high-pressure steam stop valve 61 includes a so-called interlocking test. The interlocking test is a test to confirm whether the high-pressure steam stop valve 61 can be normally closed on the basis of a trip signal.

For example, when abnormality occurs in at least a part of the steam turbine plant 1 at the time of normal operation of the steam turbine plant 1, supply of the steam to the high-pressure turbine 11 needs to be stopped by closing the high-pressure steam stop valve 61. In the case where the abnormality occurs in at least a part of the steam turbine plant 1, the trip signal is output. When the abnormality occurs, the high-pressure steam stop valve 61 needs to be closed on the basis of the trip signal.

Therefore, after the high-pressure steam stop valve 61 is arranged in the high-pressure steam piping 31 in construction of the steam turbine plant 1, the interlocking test to confirm whether the high-pressure steam stop valve 61 can be normally closed on the basis of the trip signal needs to be conducted.

After the interlocking test is completed and normality of the high-pressure steam stop valve 61 is confirmed, the high-pressure steam stop valve 61 is closed (step SP4).

In the present embodiment, work to connect the high-pressure turbine bypass valve 81 arranged in the high-pressure bypass piping 41 and the low-temperature reheat steam piping 51 connected to the outlet of the high-pressure turbine 11 through the temporary piping 54 is conducted in parallel to the assembly of the high-pressure steam stop valve 61 and the interlocking test of the high-pressure steam stop valve 61 (step SP5).

The work to connect the high-pressure turbine bypass valve 81 and the low-temperature reheat steam piping 51 through the temporary piping 54 includes work to connect the high-pressure turbine bypass valve 81 and the temporary piping 54 in the state where the high-pressure turbine bypass valve 81 is disassembled, as described with reference to FIG. 12 and the like.

The blowing out is conducted after the high-pressure turbine bypass valve 81 and the low-temperature reheat steam piping 51 (check valve 3) are connected through the temporary piping 54 (step SP6). That is, the steam is supplied from the high-pressure heating unit 21 to the piping system 1000. The steam supplied from the high-pressure heating unit 21 passes through the first pipe section 101 and the second pipe section 102 of the piping member 100, the temporary piping 54, the pipe section 201 and the pipe section 202 of the piping member 200, the low-temperature reheat steam piping 51, and the intermediate-pressure steam piping 32. Accordingly, the first pipe section 101 and the second pipe section 102 of the piping member 100, the pipe section 201 and the pipe section 202 of the piping member 200, the low-temperature reheat steam piping 51, and the intermediate-pressure steam piping 32 are cleaned.

In the present embodiment, the steam is supplied from the high-pressure heating unit 21 in the state where the high-pressure steam stop valve 61 is closed, and the blowing out is conducted. Therefore, inflow of the blow-out steam into the high-pressure turbine 11 is suppressed.

After the cleaning by the blowing out is completed, the temporary piping 54 is detached from the high-pressure turbine bypass valve 81 (step SP7). The valve body 81B and the cover member 81C are attached to the housing 81A. Accordingly, the high-pressure turbine bypass valve 81 is assembled (step SP8).

After the assembly of the high-pressure turbine bypass valve 81, the interlocking test of the high-pressure turbine bypass valve 81 is not necessary. The high-pressure bypass piping 41 in which the high-pressure turbine bypass valve 81 is arranged is not connected with the inlet of the high-pressure turbine 11. The high-pressure turbine bypass valve 81 is not necessarily closed on the basis of the trip signal. Therefore, the interlocking test of the high-pressure turbine bypass valve 81 is not necessary.

After the interlocking test of the high-pressure steam stop valve 61, the blowing out, and the assembly of the high-pressure turbine bypass valve 81 are completed, the steam turbine plant 1 becomes able to be operated.

As described above, according to the present embodiment, since the angle θ1 made by the first central axis AX1 of the first pipe section 101 and the second central axis AX2 of the second pipe section 102 is larger than the angle θ2 made by the first central axis AX1 of the first pipe section 101 and the third central axis AX3 of the third pipe section 103, inflow of the steam supplied to the first pipe section 101 into the third pipe section 103 can be suppressed in the blowing out. According to the present embodiment, since the angle θ1 is made larger than the angle θ2, the flow rate (the flow velocity or the pressure) of the steam flowing from the first pipe section 101 into the third pipe section 103 can be made lower than the flow rate (the flow velocity or the pressure) of the steam flowing from the first pipe section 101 into the second pipe section 102. Since the steam supplied to the first pipe section 101 is supplied principally to the second pipe section 102, movement of the foreign substances from the first pipe section 101 into the third pipe section 103 is suppressed. Since the amount of the foreign substances moved from the first pipe section 101 into the third pipe section 103 is suppressed, contamination of at least downstream portions of the junction with the bypass piping 40 (the high-pressure bypass piping 41, the intermediate-pressure bypass piping 42, and the low-pressure bypass piping 43), of the third pipe section 103, the steam stop valve 60 (the high-pressure steam stop valve 61, the intermediate-pressure steam stop valve 62, and the low-pressure steam stop valve 63), and the steam piping 30 (the high-pressure steam piping 31, the intermediate-pressure steam piping 32, and the low-pressure steam piping 33) is suppressed. Therefore, the blowing out of the steam piping 30 can be omitted. Therefore, an increase in the time required for the blowing out can be suppressed.

Further, according to the present embodiment, supply of the steam from the steam generation device 20 (the high-pressure heating unit 21, the reheating unit 24, and the low-pressure heating unit 23) is performed in the state where the steam stop valve 60 (the high-pressure steam stop valve 61, the intermediate-pressure steam stop valve 62, and the low-pressure steam stop valve 63) is closed. Therefore, movement of the foreign substances into at least the downstream portions of the junction with the bypass piping 40 (the high-pressure bypass piping 41, the intermediate-pressure bypass piping 42, and the low-pressure bypass piping 43), of the steam piping 30 (the high-pressure steam piping 31, the intermediate-pressure steam piping 32, and the low-pressure steam piping 33) in which the steam stop valve 60 is arranged, and movement of the foreign substances into the steam turbine 10 (the high-pressure turbine 11, the intermediate-pressure turbine 12, and the low-pressure turbine 13) through the steam piping 30 are suppressed. Accordingly, contamination of the steam piping 30 is suppressed, and the blowing out of the steam piping 30 can be omitted. Therefore, an increase in the time required for the blowing out is suppressed.

Further, according to the present embodiment, the first pipe section 101, the second pipe section 102, the pipe section 201, the pipe section 202, the low-temperature reheat steam piping 51, and the intermediate-pressure steam piping 32 can be cleaned by one-time blowing out. In the present embodiment, the first welding treatment and the second welding treatment are differently used. The blowing out is conducted for the piping for which the first welding treatment has been conducted for shortening a work period of welding. Optimization of the shape of the piping member 100, optimization of arrangement of the valves, and selection of the piping for which the first welding treatment is conducted are performed so that the piping system 1000 can be extensively cleaned by the one-time blowing out. The second welding treatment is conducted for the piping for which the blowing out is not conducted. In the present embodiment, the optimization of the shape of the piping member 100, the optimization of arrangement of the valves, the selection of the piping for which the first welding treatment is conducted, and the selection of the piping for which the second welding treatment is conducted are performed in consideration of shortening of a construction period including a decrease in the number of times of the blowing out.

Further, in the present embodiment, the first central axis AX1 and the second central axis AX2 are parallel. Therefore, the steam supplied to the first pipe section 101 is smoothly supplied to the second pipe section 102. Therefore, the movement of the foreign substances from the first pipe section 101 into the third pipe section 103 is sufficiently suppressed.

Further, in the present embodiment, the first central axis AX1 and the second central axis AX2 coincide with each other. Accordingly, the first pipe section 101 and the second pipe section 102 are formed in a straight pipe shape. Therefore, the foreign substances in the first pipe section 101 are smoothly moved into the second pipe section 102, and the movement of the foreign substances from the first pipe section 101 into the third pipe section 103 is sufficiently suppressed.

Further, in the present embodiment, the first central axis AX1 and the third central axis AX3 are perpendicular to each other. Accordingly, the movement of the foreign substances from the first pipe section 101 into the third pipe section 103 is sufficiently suppressed.

Further, in the present embodiment, the opening 108 is arranged above the central axis AX4 of the connection section 104. Accordingly, even if at least a part of the foreign substances in the first pipe section 101 is moved into the third pipe section 103 through the opening 108, the foreign substances drop from the third pipe section 103 due to the action of gravity. Therefore, contamination of the third pipe section 103, the steam piping 30 (the high-pressure steam piping 31 in the present example), and the steam stop valve 60 (the high-pressure steam stop valve 61 in the present example) is suppressed. The same applies to the intermediate-pressure steam piping 32, the low-pressure steam piping 33, the intermediate-pressure steam stop valve 62, and the low-pressure steam stop valve 63.

Further, in the present embodiment, the inlet of the steam stop valve 60, into which the steam from the third pipe section 103 flows, (the inlet 61A of the high-pressure steam stop valve 61 in the present example) is arranged above the central axis AX4 of the connection section 104. Accordingly, even if at least a part of the foreign substances in the first pipe section 101 is moved into the vicinity of the inlet 61A of the high-pressure steam stop valve 61 through the third pipe section 103, the foreign substances drop through the inlet 61A of the high-pressure steam stop valve 61 due to the action of gravity. Therefore, contamination of the high-pressure steam stop valve 61 is suppressed. The same applies to the intermediate-pressure steam stop valve 62 and the low-pressure steam stop valve 63.

Further, according to the present embodiment, the interlocking test of the steam stop valve 60 (the high-pressure steam stop valve 61 in the present example) is conducted, and the high-pressure steam stop valve 61 is closed after completion of the interlocking test. The blowing out is conducted in the state where the high-pressure steam stop valve 61 is closed. Accordingly, movement of the foreign substances into the high-pressure turbine 11 is suppressed in the blowing out. Further, since the high-pressure steam stop valve 61 is closed after normality is confirmed by the interlocking test, movement of the foreign substances into the high-pressure turbine 11 is prevented in advance. The same applies to the intermediate-pressure steam stop valve 62, the low-pressure steam stop valve 63, the intermediate-pressure turbine 12, and the low-pressure turbine 13.

Further, in the present embodiment, the steam piping 30 (the high-pressure steam piping 31 in the present example) and the steam stop valve 60 (the high-pressure steam stop valve 61 in the present example) are not blown out. Therefore, for example, it is not necessary to connect the temporary piping to the high-pressure steam stop valve 61. In other words, it is not necessary to disassemble the high-pressure steam stop valve 61 for the blowing out. Therefore, the number of times of the interlocking tests can be minimized. Therefore, an increase in the time required for the blowing out is suppressed.

Further, according to the present embodiment, connection between the second pipe section 102 and the high-pressure bypass piping 41, and connection between the high-pressure turbine bypass valve 81 and the temporary piping 54 are conducted in the state where the high-pressure turbine bypass valve 81 is disassembled. The high-pressure turbine bypass valve 81 is assembled after the blowing out. Accordingly, the connection between the high-pressure turbine bypass valve 81 and the temporary piping 54 is smoothly conducted. Further, the connection between the second pipe section 102 and the high-pressure bypass piping 41 is conducted in the state where the high-pressure turbine bypass valve 81 is disassembled. Therefore, the high-pressure bypass piping 41 and the second pipe section 102 can be visually recognized and inspected through the disassembled high-pressure turbine bypass valve 81.

Further, in the present embodiment, the valve disassembled for the connection of the temporary piping 54 is the turbine bypass valve 80 (the high-pressure turbine bypass valve 81). The high-pressure bypass piping 41 in which the high-pressure turbine bypass valve 81 is arranged is not connected with the high-pressure turbine 11. That is, the steam that passes through the high-pressure turbine bypass valve 81 is not supplied to the high-pressure turbine 11. As for the high-pressure turbine bypass valve 81, the interlocking test can be omitted. Therefore, the steam turbine plant 1 can be promptly started after the high-pressure turbine bypass valve 81 is assembled. Accordingly, an increase in the time required for the blowing out is suppressed.

Note that, in the present embodiment, the high-pressure turbine bypass valve 81 and the low-temperature reheat steam piping 51 (check valve 3) are connected using the temporary piping 54. Accordingly, flow of the steam into the pipe section 203 of the piping member 200 can be suppressed in the blowing out. Therefore, contamination of the pipe section 203 is suppressed. Further, the temporary piping 54 is replaceable, and the temporary piping 54 having various dimensions (inner diameters) are selectable. For example, in a case where the dimension (inner diameter) of the high-pressure bypass piping 41 between the high-pressure turbine bypass valve 81 and the low-temperature reheat steam piping 51 is small, and when the steam sent out from the high-pressure heating unit 21 is sent to the low-temperature reheat steam piping 51 through the high-pressure bypass piping 41 without using the temporary piping 54, there is a possibility that the flow velocity or the pressure of the steam flowing in the low-temperature reheat steam piping 51 becomes insufficient to remove the foreign substances. That is, in a case of using the high-pressure bypass piping 41 having a small dimension without using the temporary piping 54, there is a possibility that sufficient cleaning power cannot be obtained in the low-temperature reheat steam piping 51. According to the present embodiment, the sufficient cleaning power can be obtained by use of the temporary piping 54. In a case where the dimension of the high-pressure bypass piping 41 is large and the sufficient cleaning power can be obtained in the low-temperature reheat steam piping 51, the temporary piping 54 may not be used.

Note that, in the present embodiment, the shape of the first passage 101R in the plane perpendicular to the first central axis AX1 is a circle, the shape of the second passage 102R in the plane perpendicular to the second central axis AX2 is a circle, and the shape of the third passage 103R in the plane perpendicular to the third central axis AX3 is a circle. The shape of the first passage 101R in the plane perpendicular to the first central axis AX1 may be an oval or a polygon. The shape of the second passage 102R in the plane perpendicular to the second central axis AX2 may be an oval or a polygon. The shape of the third passage 103R in the plane perpendicular to the third central axis AX3 may be an oval or a polygon. The shape of the first passage 101R, the shape of the second passage 102R, and the shape of the third passage 103R may be the same. At least one of the shape of the first passage 101R, the shape of the second passage 102R, and the shape of the third passage 103R may be different. The same applies to the following embodiments.

Note that, in the present embodiment, the dimension (inner diameter) of the first passage 101R, the dimension (inner diameter) of the second passage 102R, and the dimension (inner diameter) of the third passage 103R are substantially equal. At least one of the dimension of the first passage 101R, the dimension of the second passage 102R, and the dimension of the third passage 103R may be different. The same applies to the following embodiments.

Note that, in the present embodiment, the piping member 100 arranged in the junction between the high-pressure steam piping 31 and the high-pressure bypass piping 41 has been mainly described. With the piping member 100 arranged in the junction between the intermediate-pressure steam piping 32 and the intermediate-pressure bypass piping 42, and the piping member 100 arranged in the junction between the low-pressure steam piping 33 and the low-pressure bypass piping 43, one can obtain function and effect similar to those of the piping member 100 arranged in the junction between the high-pressure steam piping 31 and the high-pressure bypass piping 41. The same applies to the following embodiments.

Second Embodiment

A second embodiment will be described. In the following description, constituent portions that are the same as or equivalent to those of the above-described embodiment are denoted with the same reference signs, and the description thereof is simplified or omitted.

Figure 16:
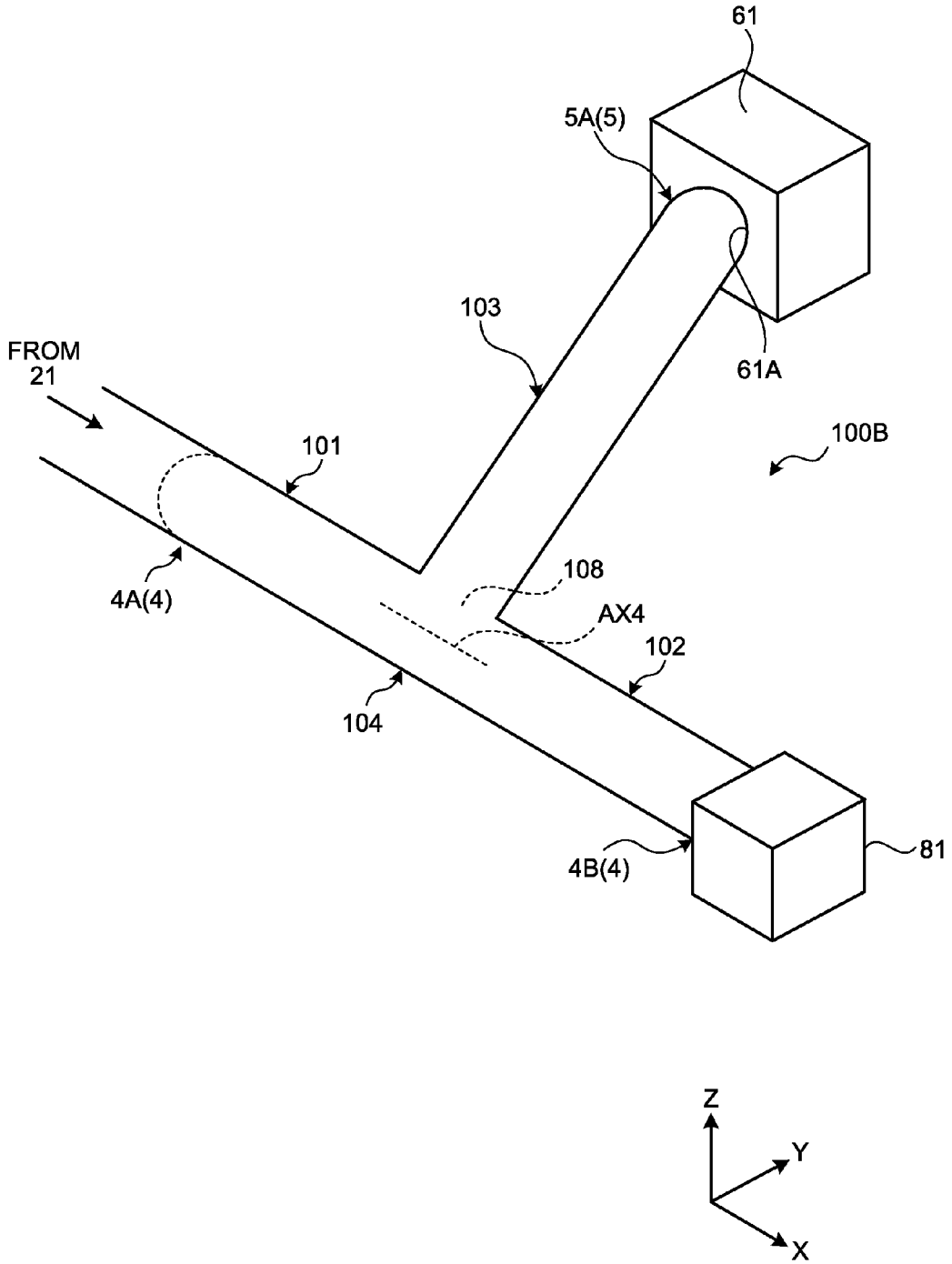
FIG. 16 is a perspective view schematically illustrating an example of a piping system according to a second embodiment.

FIG. 16 is a perspective view illustrating an example of a piping member 100B according to the present embodiment. The piping member 100B includes a first pipe section 101, a second pipe section 102, a third pipe section 103, and a connection section 104. An opening 108 is arranged above (in a +Z direction of) a central axis AX4 of the connection section 104. An inlet 61A of a high-pressure steam stop valve 61 is arranged above (in the +Z direction of) the central axis AX4 of the connection section 104.

In the present embodiment, the third pipe section 103 does not have a bent section. The third pipe section 103 is a straight pipe. The third pipe section 103 (a third central axis AX3 of the third pipe section 103) is inclined with respect to a horizontal plane (XY plane).

In the present embodiment, too, movement of foreign substances from the first pipe section 101 into the third pipe section 103 is suppressed.

Third Embodiment

Figure 17:
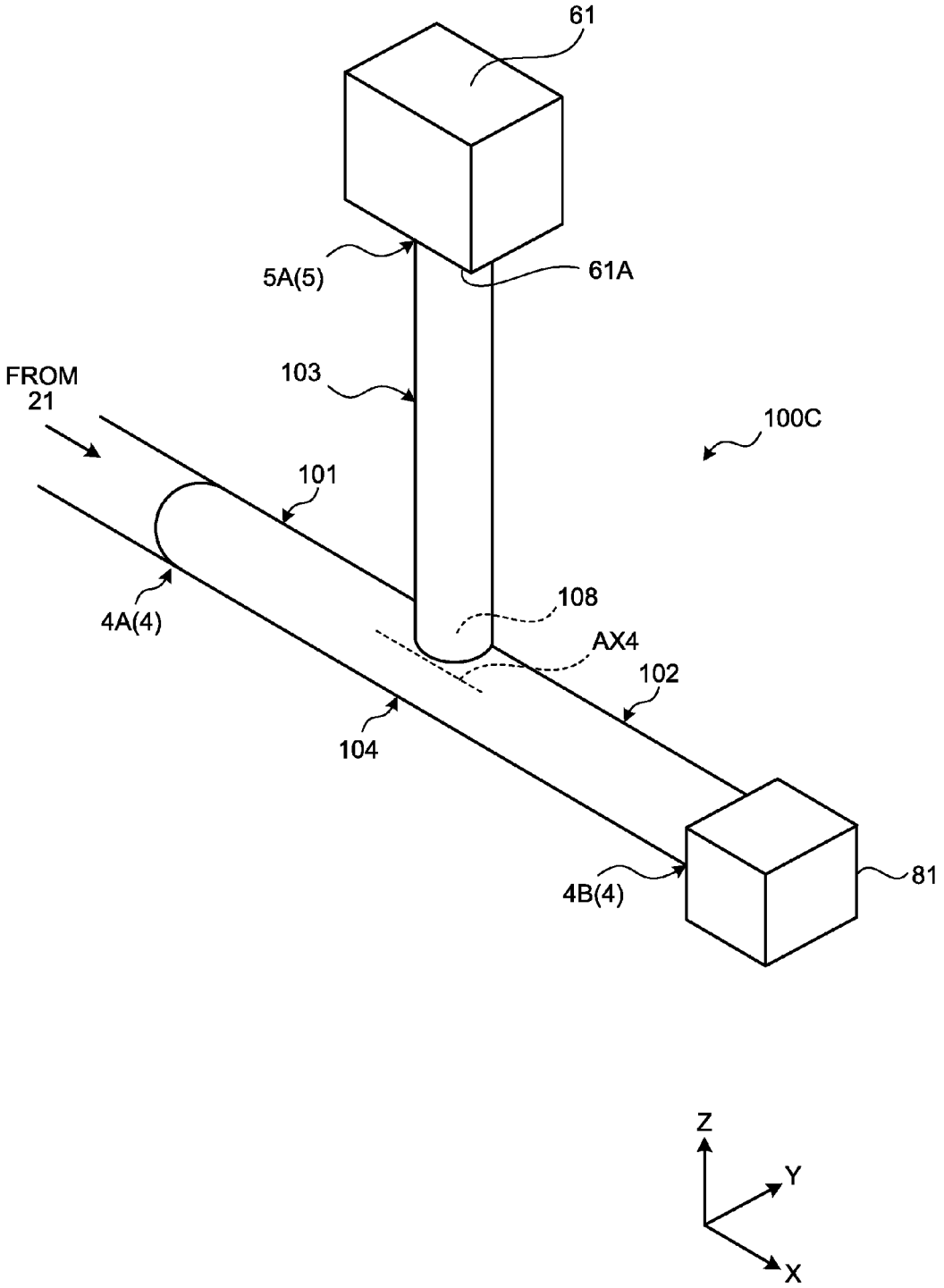
FIG. 17 is a perspective view schematically illustrating an example of a piping system according to a third embodiment.

FIG. 17 is a perspective view illustrating an example of a piping member 100C according to the present embodiment. The piping member 100C includes a first pipe section 101, a second pipe section 102, a third pipe section 103, and a connection section 104. An opening 108 is arranged above (in a +Z direction of) a central axis AX4 of the connection section 104. An inlet 61A of a high-pressure steam stop valve 61 is arranged above (in the +Z direction of) the central axis AX4 of the connection section 104.

In the present embodiment, the third pipe section 103 does not have a bent section. The third pipe section 103 is a straight pipe. The third pipe section 103 (a third central axis AX3 of the third pipe section 103) is perpendicular to a horizontal plane (XY plane).

In the present embodiment, too, movement of foreign substances from the first pipe section 101 into the third pipe section 103 is suppressed.

Fourth Embodiment

Figure 18:
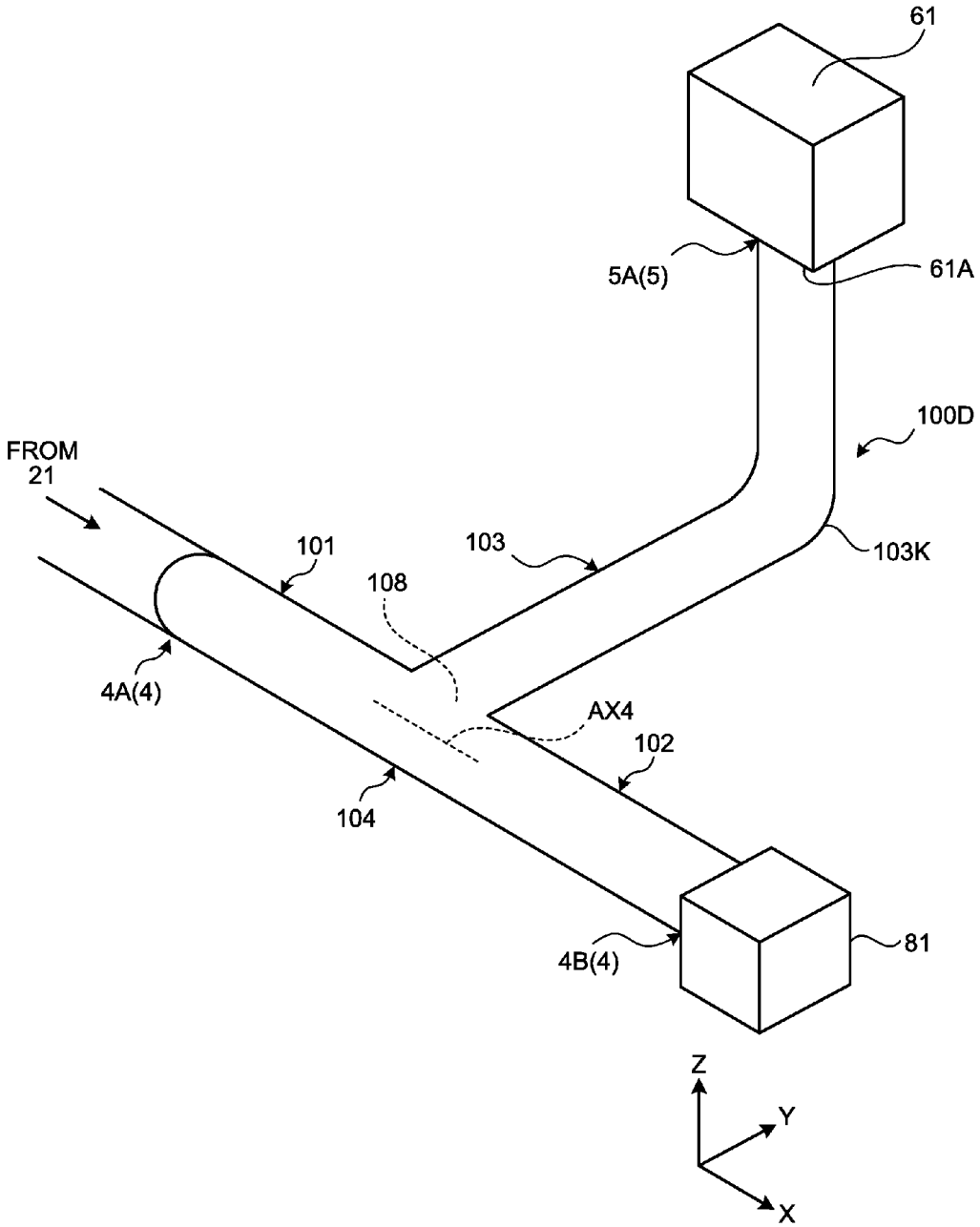
FIG. 18 is a perspective view schematically illustrating an example of a piping system according to a fourth embodiment.

FIG. 18 is a perspective view illustrating an example of a piping member 100D according to the present embodiment. The piping member 100D includes a first pipe section 101, a second pipe section 102, a third pipe section 103, and a connection section 104.

In the present embodiment, an opening 108 is arranged at the same height as a central axis AX4 of the connection section 104. The height refers to a position in a Z-axis direction. An inlet 61A of a high-pressure steam stop valve 61 is arranged above the central axis AX4 of the connection section 104. In the present embodiment, the third pipe section 103 includes a bent section 103K.

In the present embodiment, too, movement of foreign substances from the first pipe section 101 into the third pipe section 103 is suppressed.

Fifth Embodiment

Figure 19:
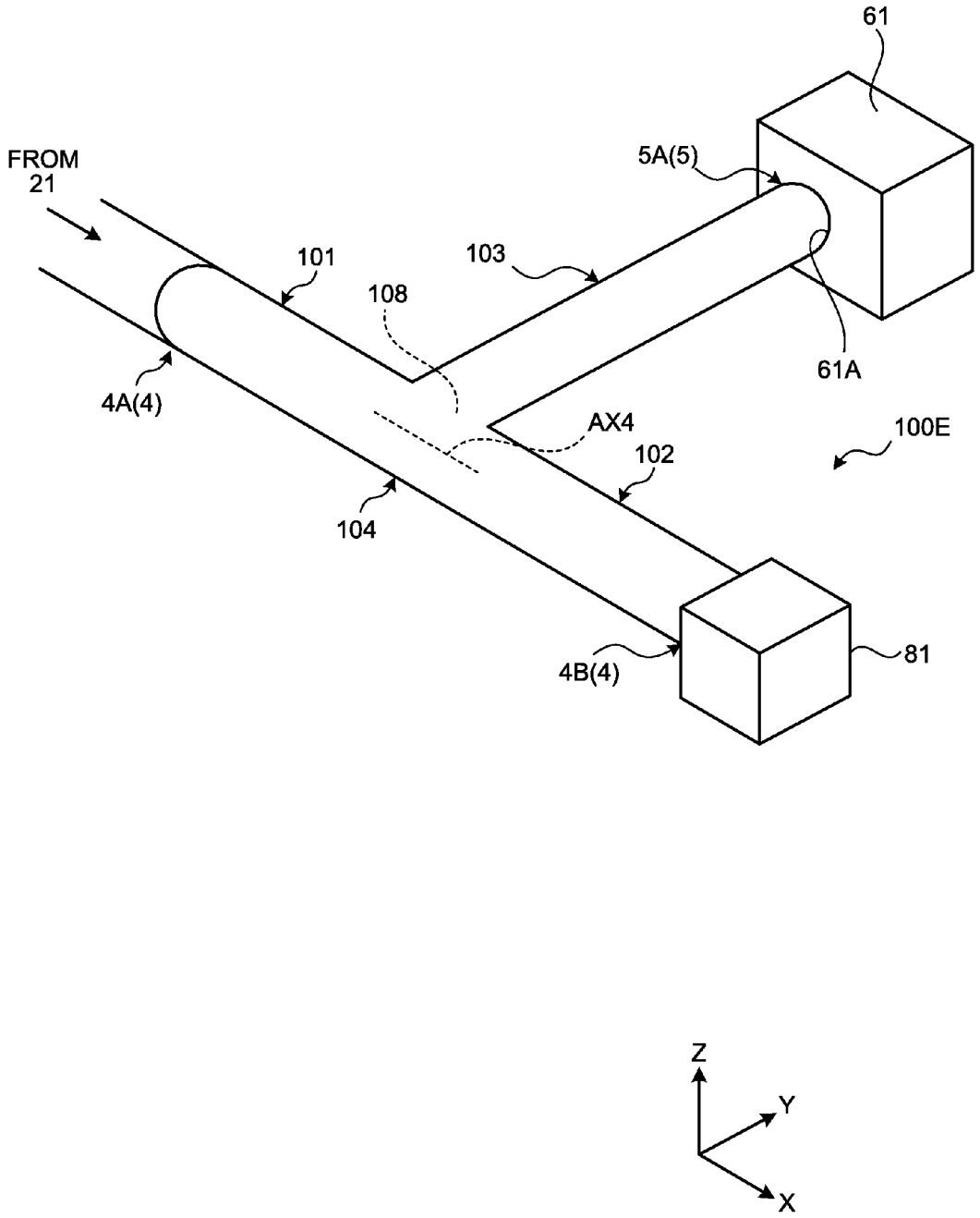
FIG. 19 is a perspective view schematically illustrating an example of a piping system according to a fifth embodiment.

FIG. 19 is a perspective view illustrating an example of a piping member 100E according to the present embodiment. The piping member 100E includes a first pipe section 101, a second pipe section 102, a third pipe section 103, and a connection section 104.

In the present embodiment, an opening 108 is arranged at the same height as a central axis AX4 of the connection section 104. An inlet 61A of a high-pressure steam stop valve 61 is arranged at the same height as the central axis AX4 of the connection section 104. In the present embodiment, the third pipe section 103 does not have a bent section. The third pipe section 103 is a straight pipe.

In the present embodiment, too, movement of foreign substances from the first pipe section 101 into the third pipe section 103 is suppressed.

Sixth Embodiment

Figure 20:
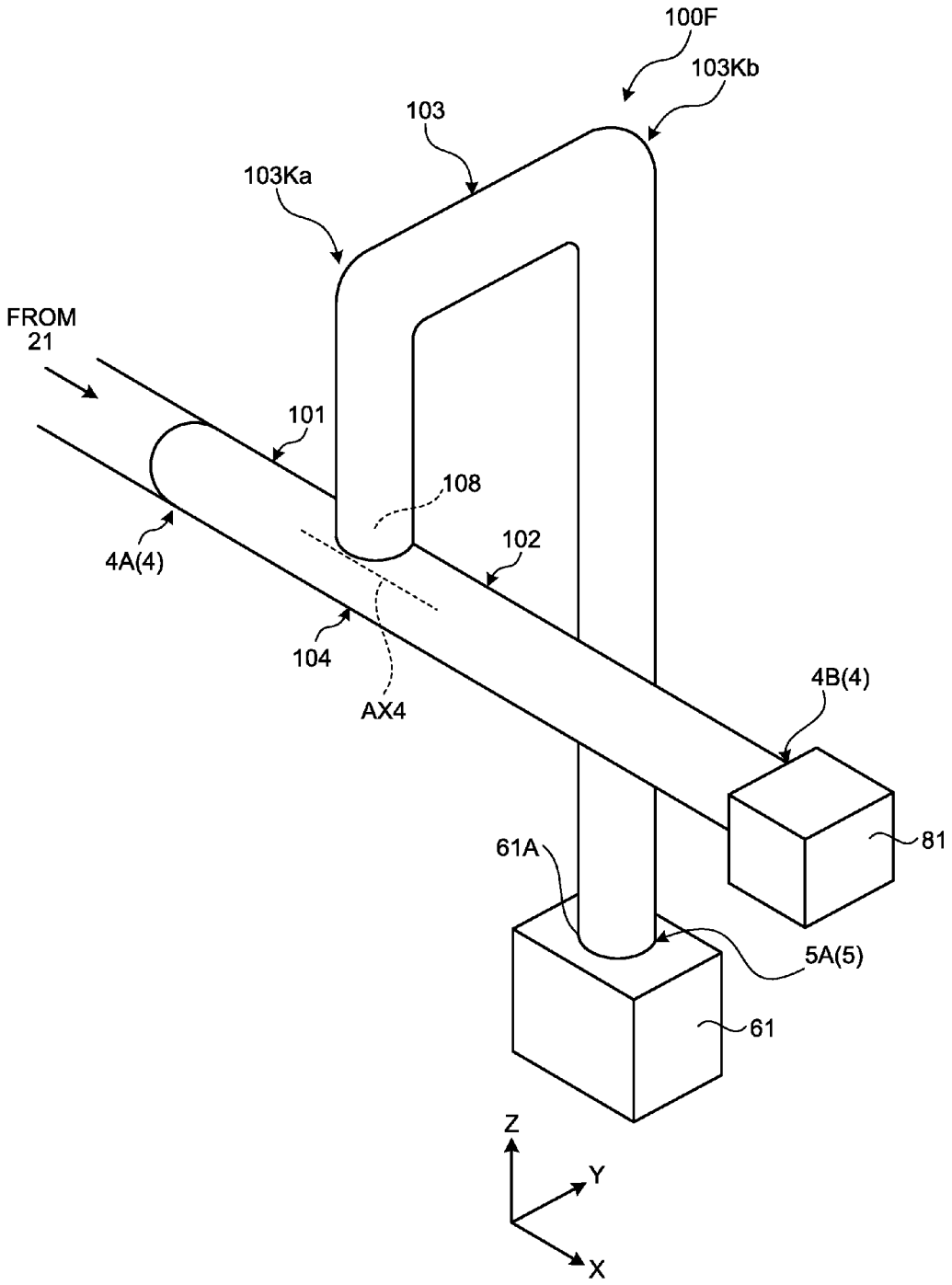
FIG. 20 is a perspective view schematically illustrating an example of a piping system according to a sixth embodiment.

FIG. 20 is a perspective view illustrating an example of a piping member 100F according to the present embodiment. The piping member 100F includes a first pipe section 101, a second pipe section 102, a third pipe section 103, and a connection section 104.

In the present embodiment, an opening 108 is arranged above (in a +Z direction of) a central axis AX4 of the connection section 104. An inlet 61A of a high-pressure steam stop valve 61 is arranged below (in a −Z direction of) the central axis AX4 of the connection section 104. In the present embodiment, the third pipe section 103 includes a bent section 103Ka and a bent section 103Kb.

In the present embodiment, too, movement of foreign substances from the first pipe section 101 into the third pipe section 103 is suppressed.

Seventh Embodiment

Figure 21:
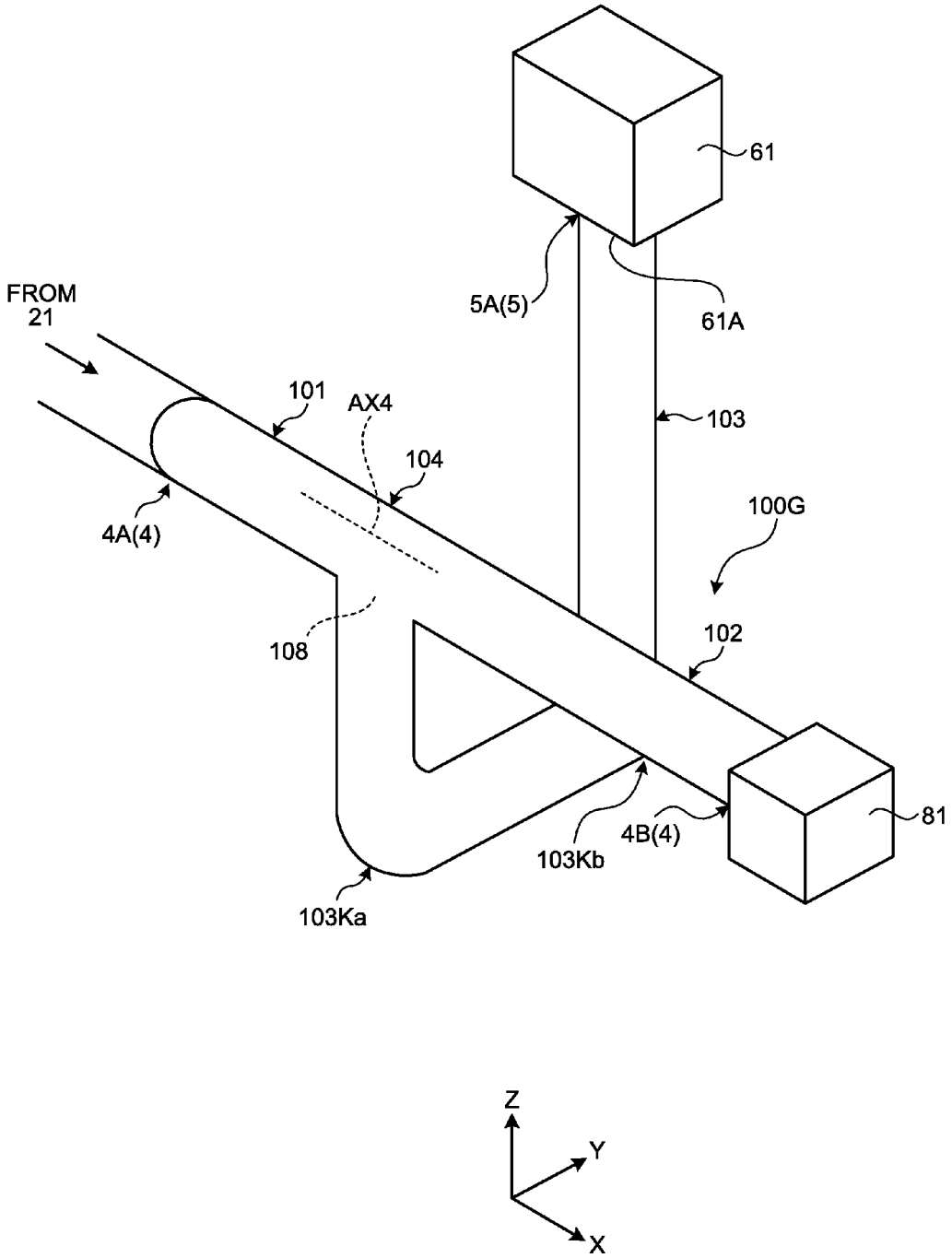
FIG. 21 is a perspective view schematically illustrating an example of a piping system according to a seventh embodiment.

FIG. 21 is a perspective view illustrating an example of a piping member 100G according to the present embodiment. The piping member 100G includes a first pipe section 101, a second pipe section 102, a third pipe section 103, and a connection section 104.

In the present embodiment, the opening 108 is arranged below (in a −Z direction of) a central axis AX4 of the connection section 104. An inlet 61A of a high-pressure steam stop valve 61 is arranged above (in a +Z direction of) the central axis AX4 of the connection section 104. In the present embodiment, the third pipe section 103 includes a bent section 103Ka and a bent section 103Kb.

In the present embodiment, too, movement of foreign substances from the first pipe section 101 into the third pipe section 103 is suppressed.

Eighth Embodiment

Figure 22:
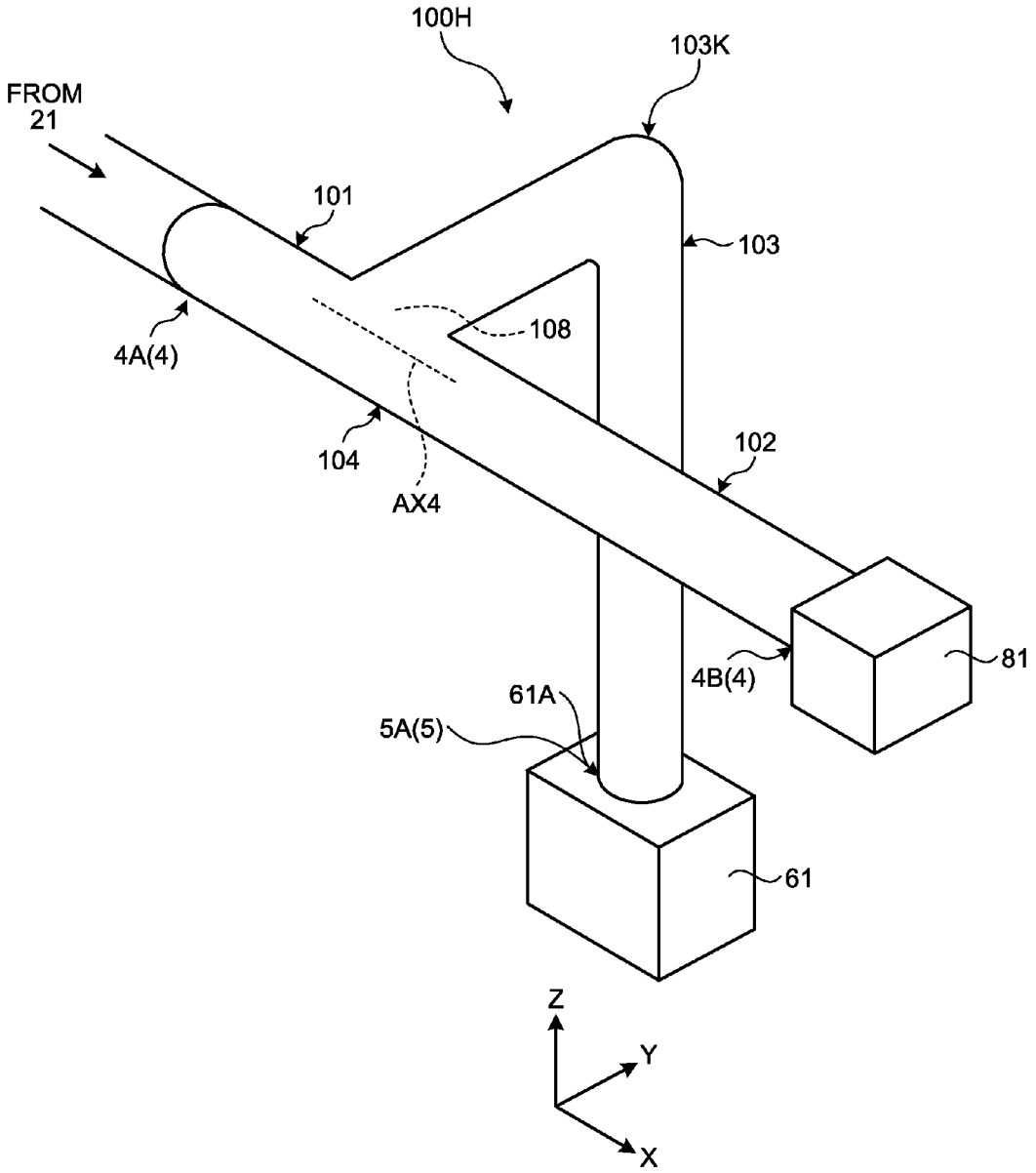
FIG. 22 is a perspective view schematically illustrating an example of a piping system according to an eighth embodiment.

FIG. 22 is a perspective view illustrating an example of a piping member 100H according to the present embodiment. The piping member 100H includes a first pipe section 101, a second pipe section 102, a third pipe section 103, and a connection section 104.

In the present embodiment, an opening 108 is arranged at the same height as a central axis AX4 of the connection section 104. An inlet 61A of a high-pressure steam stop valve 61 is arranged below the central axis AX4 of the connection section 104. In the present embodiment, the third pipe section 103 includes a bent section 103K.

In the present embodiment, too, movement of foreign substances from the first pipe section 101 into the third pipe section 103 is suppressed.

Ninth Embodiment

Figure 23:
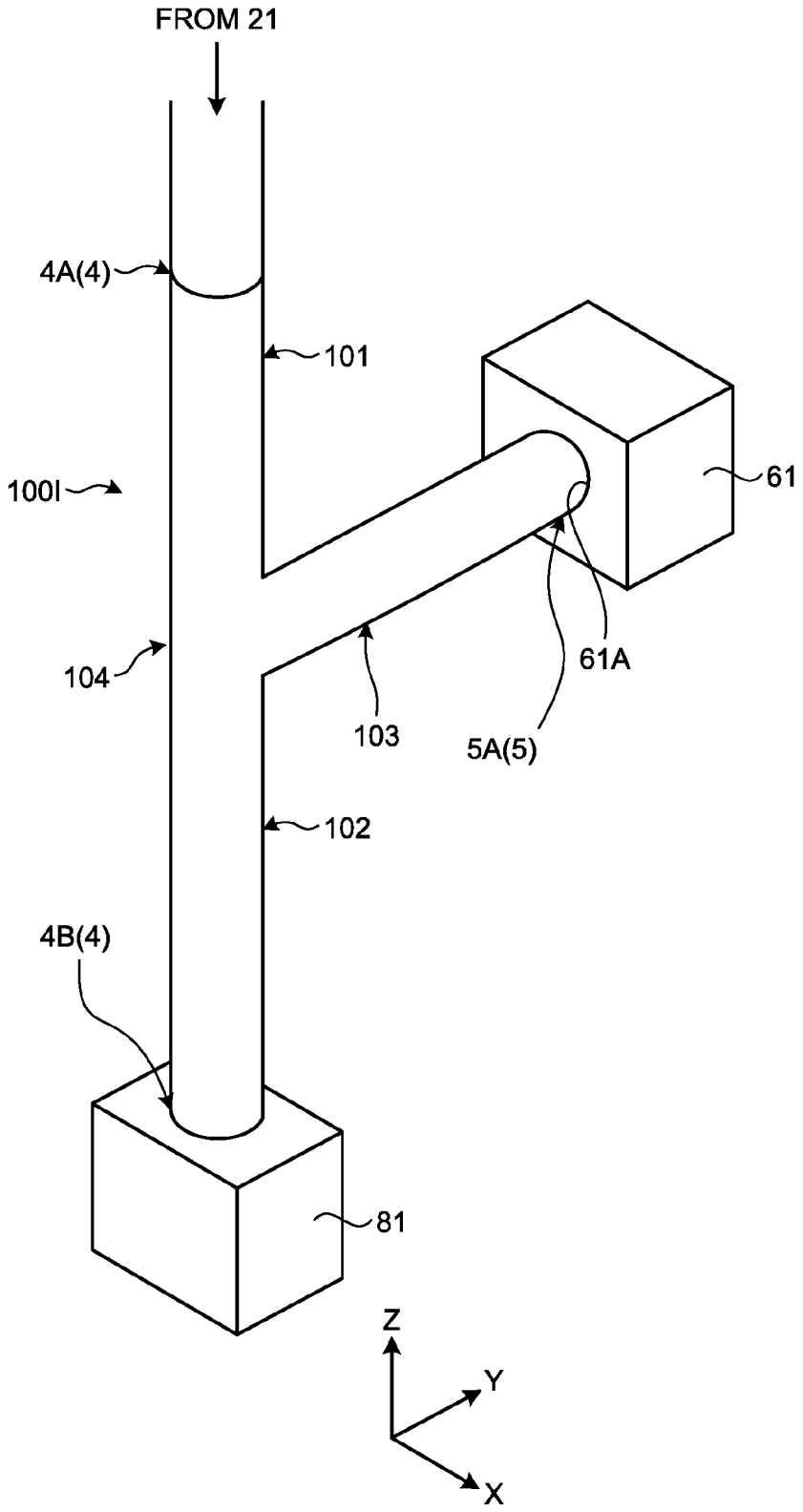
FIG. 23 is a perspective view schematically illustrating an example of a piping system according to a ninth embodiment.

FIG. 23 is a perspective view illustrating an example of a piping member 100I according to the present embodiment. The piping member 100I includes a first pipe section 101, a second pipe section 102, a third pipe section 103, and a connection section 104.

In the present embodiment, the first pipe section 101 is arranged above (in a +Z direction of) the second pipe section 102.

In the present embodiment, too, movement of foreign substances from the first pipe section 101 into the third pipe section 103 is suppressed.

Tenth Embodiment

Figure 24:
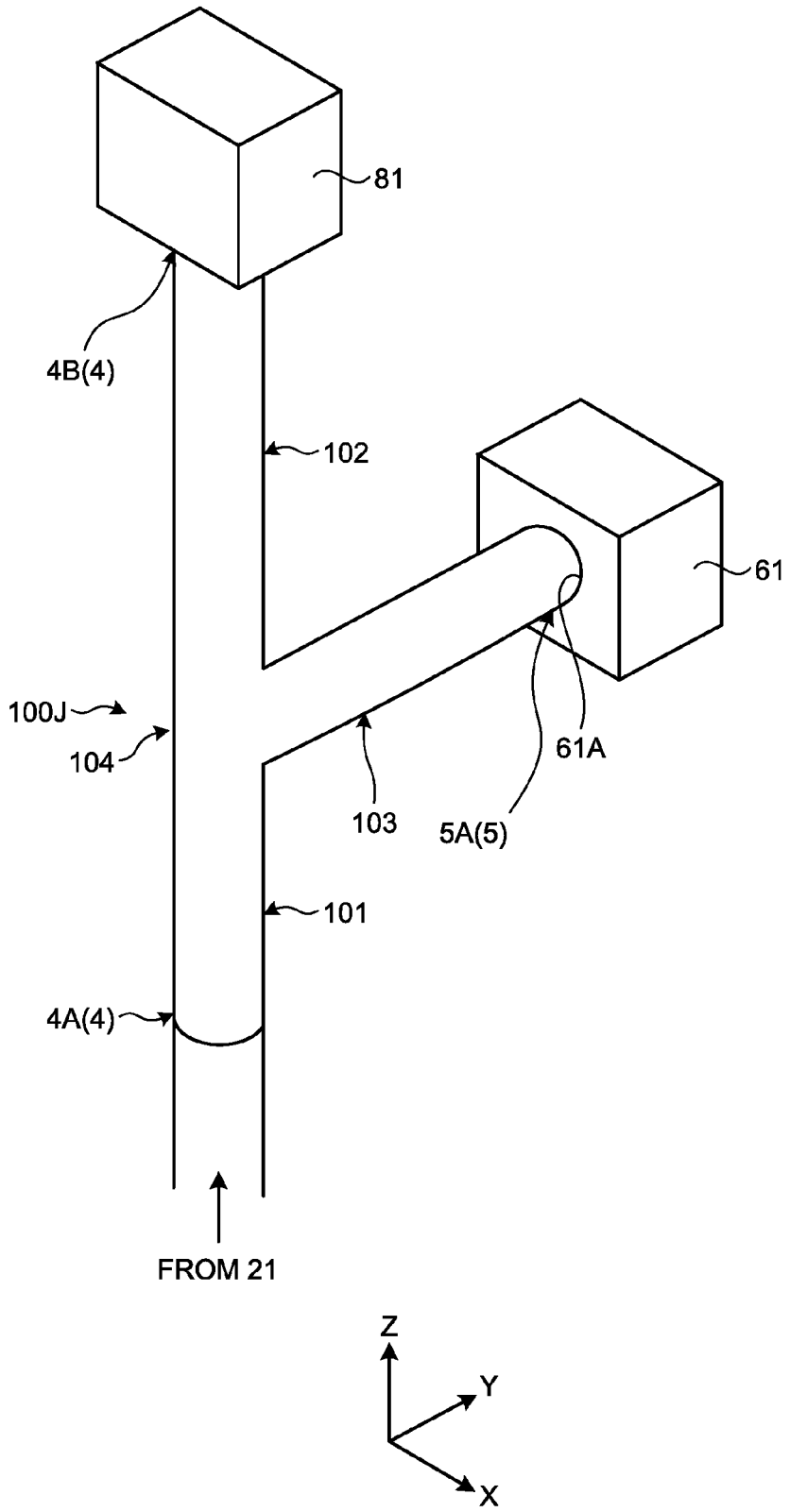
FIG. 24 is a perspective view schematically illustrating an example of a piping system according to a tenth embodiment.

FIG. 24 is a perspective view illustrating an example of a piping member 100J according to the present embodiment. The piping member 100J includes a first pipe section 101, a second pipe section 102, a third pipe section 103, and a connection section 104.

In the present embodiment, the second pipe section 102 is arranged above (in a +Z direction of) the first pipe section 101.

In the present embodiment, too, movement of foreign substances from the first pipe section 101 into the third pipe section 103 is suppressed.

The high-pressure turbine bypass valve 81 is closed at the time of normal operation of the steam turbine plant 1. Therefore, the steam in the second pipe section 102 stagnates, and tends to be liquefied. In the present embodiment, the liquid drops due to the action of gravity even if the steam is liquefied in the second pipe section 102. Therefore, accumulation of the liquid in the second pipe section 102 is suppressed. Further, movement of the liquid into the high-pressure turbine bypass valve 81 or to the high-pressure steam stop valve 61 is suppressed.

Eleventh Embodiment

Figure 25:
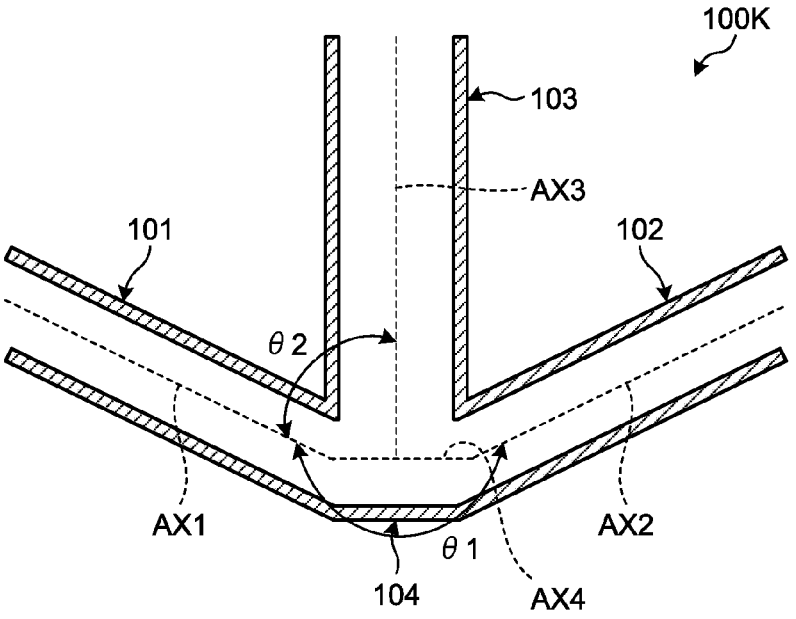
FIG. 25 is a sectional view schematically illustrating an example of a piping member according to an eleventh embodiment.

FIG. 25 is a sectional view illustrating an example of a piping member 100K according to the present embodiment. The piping member 100K includes a first pipe section 101, a second pipe section 102, a third pipe section 103, and a connection section 104.

An angle θ1 made by a first central axis AX1 of the first pipe section 101 and a second central axis AX2 of the second pipe section 102 is larger than an angle θ2 made by the first central axis AX1 of the first pipe section 101 and a third central axis AX3 of the third pipe section 103.

In the present embodiment, the first central axis AX1 and the second central axis AX2 are not parallel. The first central axis AX1 and the third central axis AX3 are not perpendicular to each other.

In the present embodiment, the angle θ1 is larger than 180 [°]. The angle θ1 is larger than 180 [°] and smaller than 210 [°], for example.

In the present embodiment, the angle θ2 is smaller than 90 [°]. The angle θ2 is smaller than 90 [°] and larger than 75 [°], for example.

In the present embodiment, too, movement of foreign substances from the first pipe section 101 into the third pipe section 103 is suppressed.

Twelfth Embodiment

Figure 26:
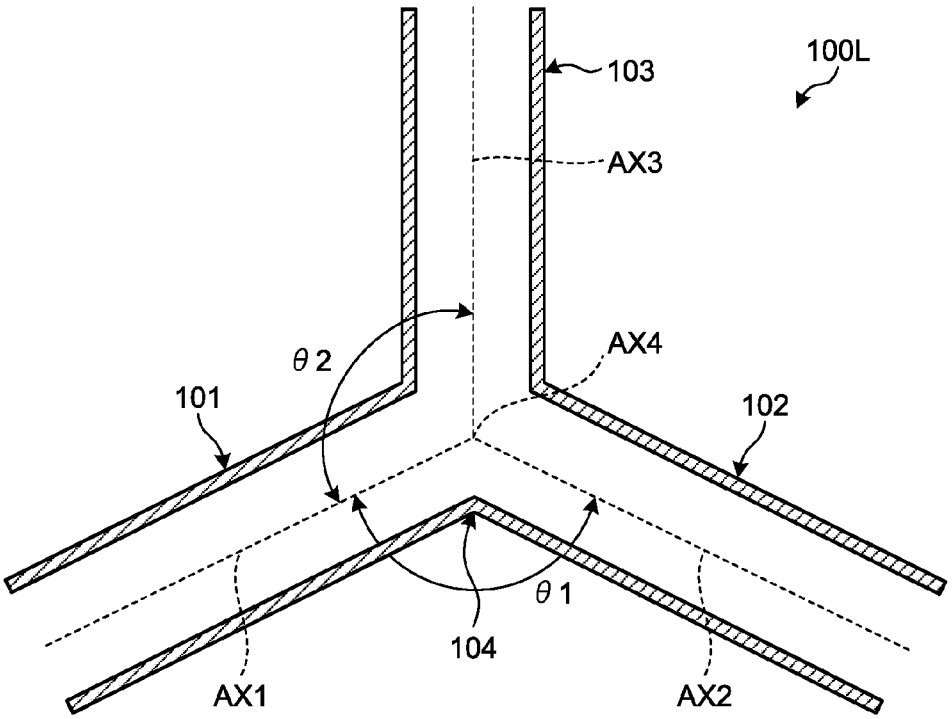
FIG. 26 is a sectional view schematically illustrating an example of a piping member according to a twelfth embodiment.

FIG. 26 is a sectional view illustrating an example of a piping member 100L according to the present embodiment. The piping member 100L includes a first pipe section 101, a second pipe section 102, a third pipe section 103, and a connection section 104.

An angle θ1 made by a first central axis AX1 of the first pipe section 101 and a second central axis AX2 of the second pipe section 102 is larger than an angle θ2 made by the first central axis AX1 of the first pipe section 101 and a third central axis AX3 of the third pipe section 103.

In the present embodiment, the first central axis AX1 and the second central axis AX2 are not parallel. The first central axis AX1 and the third central axis AX3 are not perpendicular to each other.

In the present embodiment, the angle θ1 is smaller than 180 [°]. The angle θ1 is smaller than 180 [°] and larger than 150 [°], for example.

In the present embodiment, the angle θ2 is larger than 90 [°]. The angle θ2 is larger than 90 [°] and smaller than 105 [°], for example.

In the present embodiment, too, movement of foreign substances from the first pipe section 101 into the third pipe section 103 is suppressed.

Thirteenth Embodiment

Figure 27:
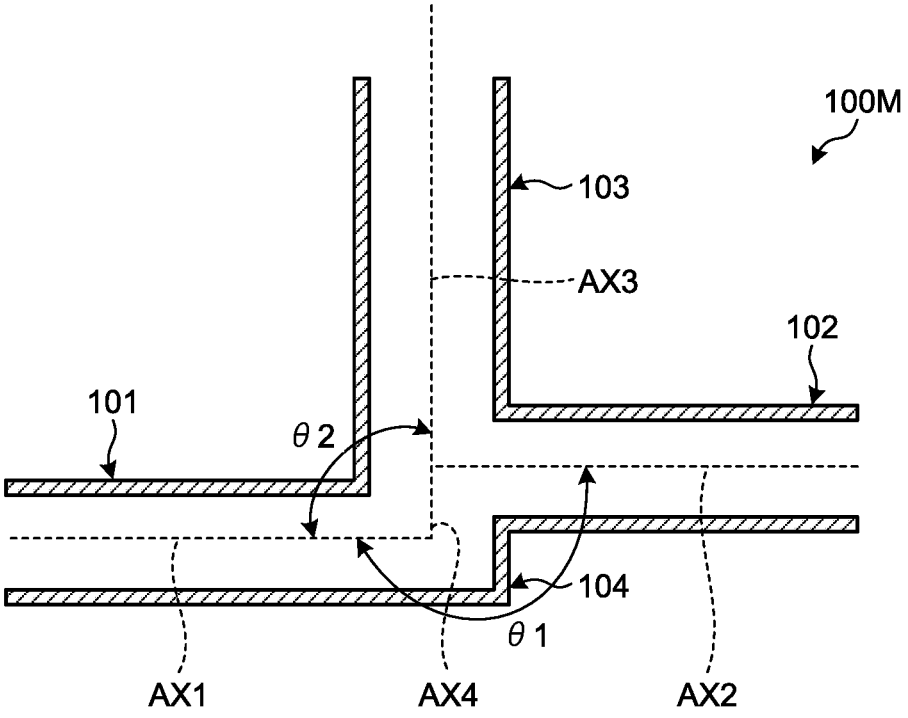
FIG. 27 is a sectional view schematically illustrating an example of a piping member according to a thirteenth embodiment.

FIG. 27 is a sectional view illustrating an example of a piping member 100M according to the present embodiment. The piping member 100M includes a first pipe section 101, a second pipe section 102, a third pipe section 103, and a connection section 104.

An angle θ1 made by a first central axis AX1 of the first pipe section 101 and a second central axis AX2 of the second pipe section 102 is larger than an angle θ2 made by the first central axis AX1 of the first pipe section 101 and a third central axis AX3 of the third pipe section 103.

In the present embodiment, the first central axis AX1 and the second central axis AX2 are parallel. The first central axis AX1 and the third central axis AX3 are perpendicular to each other.

In the present embodiment, the first central axis AX1 and the second central axis AX2 does not coincide with each other (are not the same axis). The second central axis AX2 is shifted with respect to the first central axis AX1.

In the present embodiment, too, movement of foreign substances from the first pipe section 101 into the third pipe section 103 is suppressed.

REFERENCE SIGNS LIST

1 STEAM TURBINE PLANT
2 CONDENSER
3 CHECK VALVE
4 FIRST WELDED PORTION
4A FIRST WELDED PORTION
4B FIRST WELDED PORTION
4C FIRST WELDED PORTION
4D FIRST WELDED PORTION
5 SECOND WELDED PORTION
5A SECOND WELDED PORTION
5B SECOND WELDED PORTION
10 STEAM TURBINE
11 HIGH-PRESSURE TURBINE
12 INTERMEDIATE-PRESSURE TURBINE
13 LOW-PRESSURE TURBINE
20 STEAM GENERATION DEVICE
21 HIGH-PRESSURE HEATING UNIT
22 INTERMEDIATE-PRESSURE HEATING UNIT
23 LOW-PRESSURE HEATING UNIT
24 REHEATING UNIT
30 STEAM PIPING
31 HIGH-PRESSURE STEAM PIPING (MAIN STEAM PIPING)
32 INTERMEDIATE-PRESSURE STEAM PIPING (HIGH-TEMPERATURE REHEAT STEAM PIPING)
33 LOW-PRESSURE STEAM PIPING
40 BYPASS PIPING
41 HIGH-PRESSURE BYPASS PIPING
42 INTERMEDIATE-PRESSURE BYPASS PIPING
43 LOW-PRESSURE BYPASS PIPING
51 LOW-TEMPERATURE REHEAT SYSTEM PIPING
52 PIPING
53 SUPPLY PIPING
54 TEMPORARY PIPING
60 STEAM STOP VALVE
61 HIGH-PRESSURE STEAM STOP VALVE (MAIN STEAM STOP VALVE)
61A INLET
62 INTERMEDIATE-PRESSURE STEAM STOP VALVE (REHEAT STEAM STOP VALVE)
63 LOW-PRESSURE STEAM STOP VALVE
70 CONTROL VALVE
71 HIGH-PRESSURE CONTROL VALVE (MAIN CONTROL VALVE)
72 INTERMEDIATE-PRESSURE CONTROL VALVE (REHEATING CONTROL VALVE)
73 LOW-PRESSURE CONTROL VALVE
80 TURBINE BYPASS VALVE
81 HIGH-PRESSURE TURBINE BYPASS VALVE
81A HOUSING
81B VALVE BODY
81C COVER MEMBER
81D BLOCKING MEMBER
82 INTERMEDIATE-PRESSURE TURBINE BYPASS VALVE
83 LOW-PRESSURE TURBINE BYPASS VALVE
100 PIPING MEMBER
100B PIPING MEMBER
100C PIPING MEMBER
100D PIPING MEMBER
100E PIPING MEMBER
100F PIPING MEMBER
100G PIPING MEMBER
100H PIPING MEMBER
100I PIPING MEMBER
100J PIPING MEMBER
100K PIPING MEMBER
100L PIPING MEMBER
100M PIPING MEMBER
101 FIRST PIPE SECTION
101R FIRST PASSAGE
102 SECOND PIPE SECTION
102R SECOND PASSAGE
103 THIRD PIPE SECTION
103A STRAIGHT PIPE SECTION
103B STRAIGHT PIPE SECTION
103K BENT SECTION
103Ka BENT SECTION
103Kb BENT SECTION
103R THIRD PASSAGE
104 CONNECTION SECTION
104R CONNECTION PASSAGE
105 INLET
106 OUTLET
107 OUTLET
108 OPENING
200 PIPING MEMBER
201 PIPE SECTION
202 PIPE SECTION
203 PIPE SECTION
204 CONNECTION SECTION
1000 PIPING SYSTEM
AX1 FIRST CENTRAL AXIS
AX2 SECOND CENTRAL AXIS
AX3 THIRD CENTRAL AXIS
AX4 CENTRAL AXIS

The invention claimed is:

1. A piping system of a steam turbine plant, comprising:
a piping member including a first pipe section including a first passage, a second pipe section including a second passage, a connection section arranged between the first pipe section and the second pipe section and including a connection passage that is configured to connect the first passage and the second passage, and a third pipe section including a third passage connected with the connection passage through an opening, the first pipe section being supplied with steam;
a steam stop valve connected with the third pipe section and in which steam supplied to a steam turbine flows; and
a turbine bypass valve connected with the second pipe section and connected with an outlet of the steam turbine, wherein
an angle made by a first central axis of the first pipe section and a second central axis of the second pipe section is larger than an angle made by the first central axis and a third central axis of the third pipe section.

2. The piping system according to claim 1, wherein
the first central axis and the second central axis are parallel to each other.

3. The piping system according to claim 1, wherein
the first central axis and the second central axis coincide with each other.

4. The piping system according to claim 1, wherein
the first central axis and the third central axis are perpendicular to each other.

5. The piping system according to claim 1, wherein the opening is arranged above a central axis of the connection section.

6. The piping system according to claim 1, wherein an inlet of the steam stop valve into which the steam from the third pipe section flows is arranged above a central axis of the connection section.

7. The piping system according to claim 1, wherein the second pipe section is arranged above the first pipe section.

8. A steam turbine plant comprising:

the piping system according to claim 1.

9. A method of cleaning a piping system of a steam turbine plant, the piping system including:

a piping member including a first pipe section including a first passage, a second pipe section including a second passage, a connection section arranged between the first pipe section and the second pipe section and including a connection passage that is configured to connect the first passage and the second passage, and a third pipe section including a third passage connected with the connection passage through an opening, an angle made by a first central axis of the first pipe section and a second central axis of the second pipe section being larger than an angle made by the first central axis and a third central axis of the third pipe section;

a steam generation device connected with the first pipe section;

a steam stop valve connected with the third pipe section having had an inside cleaned and in which steam supplied to a steam turbine flows; and a turbine bypass valve connected with the second pipe section and connected with an outlet of the steam turbine, the method comprising the steps of:

closing the steam stop valve; and supplying steam from the steam generation device and cleaning the first pipe section and the second pipe section.

10. The method of cleaning a piping system according to claim 9, comprising:

conducting a test to close the steam stop valve;

closing the steam stop valve after completion of the test; and supplying steam from the steam generation device in a state where the steam stop valve is closed and performing the cleaning.

11. The method of cleaning a piping system according to claim 9, comprising:

conducting connection between the second pipe section and the turbine bypass valve in a state where the turbine bypass valve is disassembled; and assembling the turbine bypass valve after the cleaning.

* * * * *